US012590540B2

(12) United States Patent
Wang et al.

(10) Patent No.: US 12,590,540 B2
(45) Date of Patent: Mar. 31, 2026

(54) BOLTER MINER AND TUNNELING SYSTEM

(71) Applicants: CCTEG TAIYUAN RESEARCH INSTITUTE, Taiyuan (CN); SHANXI TIANDI COAL MINING MACHINERY CO., LTD., Taiyuan (CN)

(72) Inventors: Bukang Wang, Taiyuan (CN); Hong Wang, Taiyuan (CN); Xiaofeng Zhang, Taiyuan (CN); Kai Ma, Taiyuan (CN); Faquan Li, Taiyuan (CN); Dianwu Wang, Taiyuan (CN); Yongcheng Ding, Taiyuan (CN); Jianwei Jia, Taiyuan (CN); Qiang Ma, Taiyuan (CN); Hao Wang, Taiyuan (CN); Yanhua Qiao, Taiyuan (CN); Xiaoli Ren, Taiyuan (CN); Xuerui Zhang, Taiyuan (CN); Feng Liu, Taiyuan (CN); Ningning Wang, Taiyuan (CN); Gehui Xie, Taiyuan (CN); Sen Xu, Taiyuan (CN); Qiang Zhang, Taiyuan (CN); Dong Song, Taiyuan (CN); Xipeng Wang, Taiyuan (CN); Wei Wang, Taiyuan (CN); Weijian Qiu, Taiyuan (CN); Zhiwei Yan, Taiyuan (CN); Jingxi Duan, Taiyuan (CN); Peng Li, Taiyuan (CN)

(73) Assignees: CCTEG Taiyuan Research Institute, Taiyuan (CN); Shanxi Tiandi Coal Mining Machinery Co., LTD., Taiyuan (CN)

( * ) Notice: Subject to any disclaimer, the term of this patent is extended or adjusted under 35 U.S.C. 154(b) by 431 days.

(21) Appl. No.: 18/556,573

(22) PCT Filed: May 27, 2022

(86) PCT No.: PCT/CN2022/095787
§ 371 (c)(1),
(2) Date: Oct. 20, 2023

(87) PCT Pub. No.: WO2023/077786
PCT Pub. Date: May 11, 2023

(65) Prior Publication Data
US 2024/0191624 A1 Jun. 13, 2024

(30) Foreign Application Priority Data
Nov. 8, 2021 (CN) ..... 202111315962.2

(51) Int. Cl.
*E21C 35/02* (2006.01)
*E21C 25/06* (2006.01)
(Continued)

(52) U.S. Cl.
CPC ..... *E21C 35/02* (2013.01); *E21C 25/06* (2013.01); *E21D 20/003* (2013.01); *E21D 23/00* (2013.01)

(58) Field of Classification Search
CPC ..... E21D 20/003; E21D 23/00; E21C 25/06; E21C 35/02
See application file for complete search history.

(56) References Cited

U.S. PATENT DOCUMENTS 5,050,934 A * 9/1991 Brandl ..... E21D 20/003 299/33
2002/0157283 A1 10/2002 Lammer et al.
(Continued)

FOREIGN PATENT DOCUMENTS

AU 2012283438 A1 3/2014
CN 1584292 A 2/2005
(Continued)

OTHER PUBLICATIONS

International Search Report corresponding to PCT Application No. PCT/CN2022/095787, mailed Aug. 8, 2022 (Chinese and English language document) (8 pages).
(Continued)

*Primary Examiner* — Janine M Kreck
(74) *Attorney, Agent, or Firm* — Maginot, Moore & Beck, LLP

(57) ABSTRACT

A bolter miner includes a rack, a cutting device and a bolt support device. The cutting device is configured for a cutting operation and is arranged on the rack to swing up and down. The bolt support device includes a lifting assembly, a work platform, a first drilling frame assembly and a stabilization assembly. The lifting assembly is arranged between the rack and the work platform and is configured to lift the work platform. The first drilling frame assembly and the stabilization assembly are arranged on the work platform. The first drilling frame assembly has a bolt support position and an avoidance position. The work platform can extend and retract to switch the bolt support position and the avoidance position of the first drilling frame assembly. The stabilization assembly can be supported between the cutting device and a tunnel roof, so as to enhance the stability of the first drilling frame assembly during a bolt support operation.

20 Claims, 13 Drawing Sheets

(51) Int. Cl.
*E21D 20/00* (2006.01)
*E21D 23/00* (2006.01)

(56) References Cited

U.S. PATENT DOCUMENTS

| | | | |
|---|---|---|---|
| 2005/0129466 | A1 | 6/2005 | Bergtechnik |
| 2010/0231026 | A1 | 9/2010 | Ebner et al. |

FOREIGN PATENT DOCUMENTS

| | | | |
|---|---|---|---|
| CN | 102472099 | A | 5/2012 |
| CN | 104081002 | A | 10/2014 |
| CN | 106194201 | A | 12/2016 |
| CN | 109736801 | A | 5/2019 |
| CN | 112682035 | A | 4/2021 |
| CN | 112727456 | A | 4/2021 |
| CN | 112796806 | A | 5/2021 |
| CN | 213478364 | U | 6/2021 |
| CN | 113202466 | A | 8/2021 |
| CN | 114017019 | A | 2/2022 |
| CN | 114017020 | A | 2/2022 |
| CN | 114017021 | A | 2/2022 |
| CN | 114017022 | A | 2/2022 |
| CN | 114033414 | A | 2/2022 |
| CN | 114109425 | A | 3/2022 |
| CN | 216866566 | U | 7/2022 |
| EP | 0149056 | A1 | 7/1985 |

OTHER PUBLICATIONS

Office Action for AU application 2022383218.

* cited by examiner

BOLTER MINER AND TUNNELING SYSTEM

CROSS-REFERENCE TO RELATED APPLICATIONS

This application is a national phase entry under 35 USC § 371 of International Application No. PCT/CN2022/095787, filed on May 27, 2022, which claims priority to and benefits of Chinese Patent Application No. 202111315962.2, filed on Nov. 8, 2021, the entire content of which is incorporated herein by reference.

FIELD

This application relates to the technical field of tunneling equipment, and more particularly to a bolter miner and a tunneling system using the bolter miner.

BACKGROUND

A bolter miner is mining equipment that can achieve tunneling and bolt support. In order to ensure the safety of tunneling operations, the bolter miner needs to perform bolt support in a timely manner after a cycle of tunneling footage, to avoid roof caving and significant bending and sinking. In the related art, a roof bolter is mostly arranged at a rear side of the bolter miner, and the roof bolter can only perform a bolt support operation on a tunnel roof at a rear side of a heading face, with a large unsupported roof distance left between the bolt support position and the tunnel heading face. When the tunnel roof is in a poor condition, collapse is prone to occurring over the unsupported roof distance, causing safety accidents, which is not conducive to safe production.

SUMMARY

A bolter miner according to embodiments of the present disclosure includes: a rack; a cutting device arranged on the rack and being swingable up and down, the cutting device being configured to perform a cutting operation; and a bolt support device including a lifting assembly, a work platform, a first drilling frame assembly, and a stabilization assembly. The lifting assembly is arranged between the rack and the work platform, and the lifting assembly is configured to lift the work platform; the first drilling frame assembly and the stabilization assembly are arranged on the work platform; the first drilling frame assembly has a bolt support position where the first drilling frame assembly is above the cutting device and is configured to perform a bolt support operation, and an avoidance position where the first drilling frame assembly is configured to avoid the cutting device to allow the cutting device to perform the cutting operation; the work platform is telescopic to switch the bolt support position and the avoidance position of the first drilling frame assembly; and the stabilization assembly is configured to be supported between the cutting device and a tunnel roof to enhance stability of the first drilling frame assembly during the bolt support operation.

A tunneling system according to embodiments of the present disclosure includes a bolter miner. The bolter miner includes: a rack; a cutting device arranged on the rack and being swingable up and down, the cutting device being configured to perform a cutting operation; and a bolt support device including a lifting assembly, a work platform, a first drilling frame assembly, and a stabilization assembly. The lifting assembly is arranged between the rack and the work platform, and the lifting assembly is configured to lift the work platform; the first drilling frame assembly and the stabilization assembly are arranged on the work platform; the first drilling frame assembly has a bolt support position where the first drilling frame assembly is above the cutting device and is configured to perform a bolt support operation, and an avoidance position where the first drilling frame assembly is configured to avoid the cutting device to allow the cutting device to perform the cutting operation; the work platform is telescopic to switch the bolt support position and the avoidance position of the first drilling frame assembly; and the stabilization assembly is configured to be supported between the cutting device and a tunnel roof to enhance stability of the first drilling frame assembly during the bolt support operation.

DETAILED DESCRIPTION

Embodiments of the present disclosure will be described in detail below, and examples of the embodiments will be shown in the accompanying drawings. The embodiments described below are exemplary and are intended to explain the present disclosure rather than limit the present disclosure.

As shown in FIGS. 1 to 20, a bolter miner 100 according to embodiments of the present disclosure includes a rack 1, a cutting device 2, and a bolt support device 3.

Figure 1:
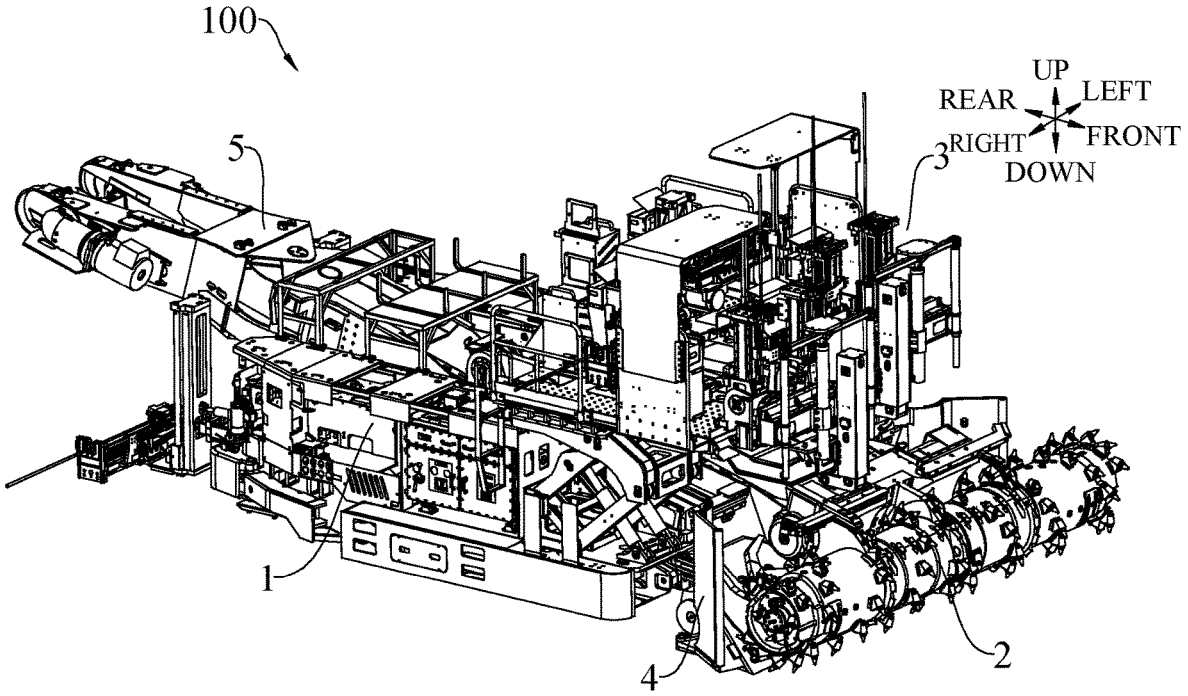
FIG. 1 is a perspective view of an overall structure of a bolter miner according to embodiments of the present disclosure.

As shown in FIG. 1, the rack 1 can be regarded as a body frame of the bolter miner 100. The bolter miner 100 includes a walking device, the cutting device 2, a shovel plate device 4, and a conveying trough device 5. The walking device, the cutting device 2, the shovel plate device 4, and the conveying trough device 5 are all assembled on the rack 1.

It should be noted that the cutting device 2 and the shovel plate device 4 are both at a front end of the rack 1. The cutting device 2 includes a cutting drum 21, and the shovel plate device 4 is located below the cutting drum 21. The conveying trough device 5 extends along a length direction (i.e., a front-rear direction) of the rack 1. Coal rock cut by the cutting drum 21 can be gathered by the shovel plate device 4 and transported to a front inlet of the conveying trough device 5, and then the coal rock can be transported backwards by the conveying trough device 5.

The walking device can be a crawler type walking device, and can be mounted below the rack 1. Through the walking device, automatic movement of the bolter miner 100 can be achieved.

Figure 2:
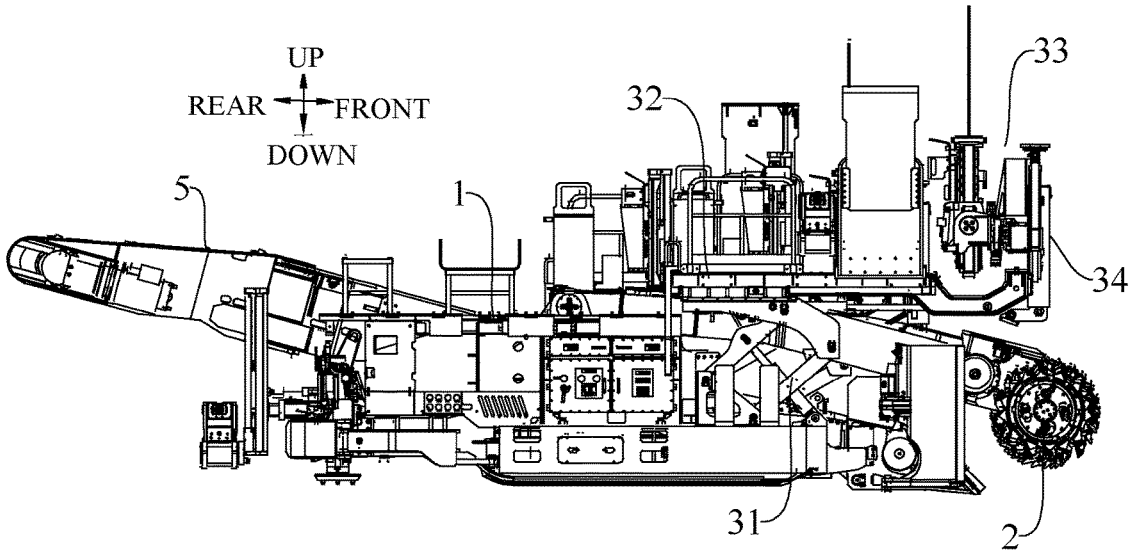
FIG. 2 is a right view of the bolter miner in FIG. 1.

The cutting device 2 is arranged on the rack 1 and is swingable in an up-down direction. The cutting device 2 is suitable for cutting operations. Specifically, as shown in FIGS. 1 and 2, the cutting device 2 includes a cutting arm and the cutting drum 21. The cutting arm generally extends in the front-rear direction, and a rear end of the cutting arm is connected to the rack 1 and is swingable in the up-down direction relative to the rack 1. The cutting drum 21 is mounted at a front end of the cutting arm. When in use, cutting operations on a front coal wall can be achieved by driving the cutting arm to swing up and down.

The bolt support device 3 includes a lifting assembly 31, a work platform 32, a first drilling frame assembly 33, and a stabilization assembly 34. The lifting assembly 31 is arranged between the rack 1 and the work platform 32, and the lifting assembly 31 is configured to lift the work platform 32. The first drilling frame assembly 33 and the stabilization assembly 34 are arranged on the work platform 32. The first drilling frame assembly 33 has a bolt support position and an avoidance position. In the bolt support position, the first drilling frame assembly 33 is located above the cutting device and is suitable for bolt support operations. In the avoidance position, the first drilling frame assembly 33 is configured to avoid the cutting device 2 so that the cutting device 2 can carry out the cutting operations. The work platform 32 can extend and retract to switch the bolt support position and the avoidance position of the first drilling frame assembly 33. The stabilization assembly 34 can be supported between the cutting device 2 and a tunnel roof to enhance the stability of the first drilling frame assembly 33 during the bolt support operations.

Figure 4:
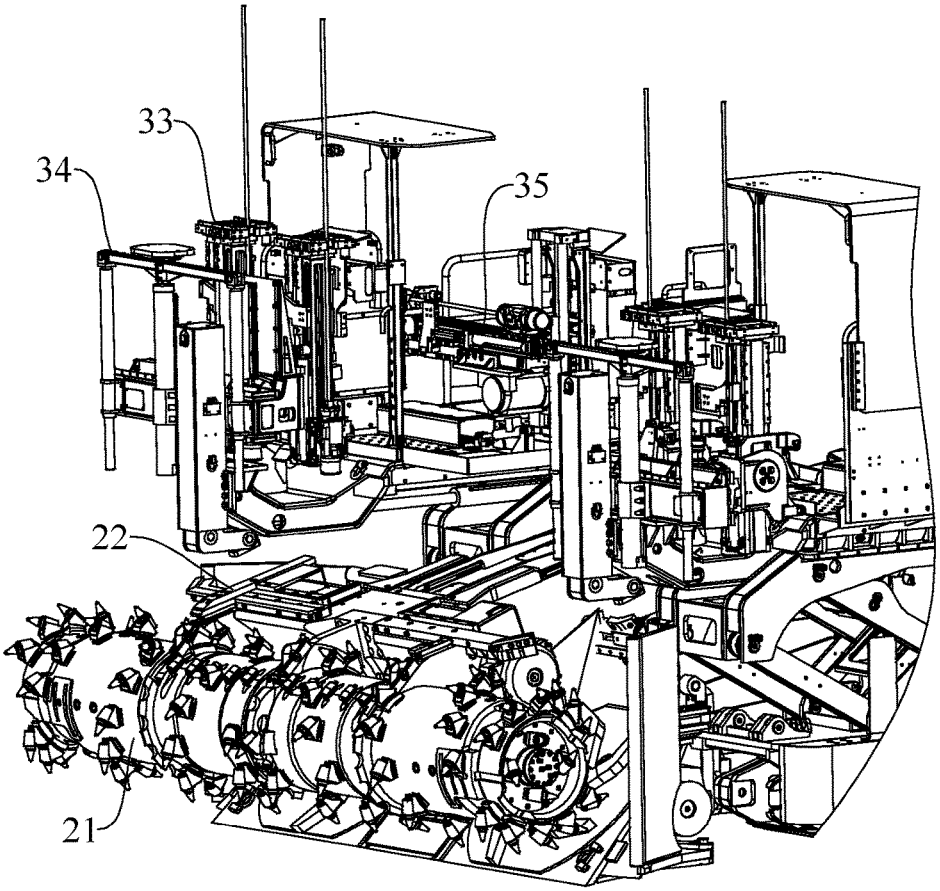
FIG. 4 is a schematic view of a front-end structure of the bolter miner in FIG. 1.

Specifically, as shown in FIGS. 2 and 4, the lifting assembly 31 can be mounted on the rack 1, and the lifting assembly 31 can include a lifting platform and a lifting oil cylinder. The lifting platform is fixed at a top of the lifting oil cylinder, and the lifting of the lifting platform can be driven through the lifting oil cylinder. The work platform 32 can be fixed on the lifting platform, and the lifting of the work platform 32 can be achieved by the lifting assembly 31.

It should be noted that the work platform 32 may be a rectangular platform, and the work platform 32 extends along the front-rear direction and is retractable in the front-rear direction. The first drilling frame assembly 33 can be mounted at a front end of the work platform 32, and the first drilling frame assembly 33 is used for bolt support operations. Specifically, when the work platform 32 extends forward, the first drilling frame assembly 33 is generally located above the cutting drum 21 of the cutting device 2, and the first drilling frame assembly 33 can perform the bolt support operations on the tunnel roof close to the heading face. At this time, the first drilling frame assembly 33 is in the bolt support position.

When cutting operations need to be carried out, the work platform 32 can be retracted, and the first drilling frame assembly 33 can be withdrawn to the rear of the cutting drum 21 of the cutting device 2, so that the cutting device 2 can drive the cutting drum 21 to move up and down by the cutting arm, to achieve the cutting operations. At this time, the first drilling frame assembly 33 switches to the avoidance position, avoiding interference with the cutting device 2.

As shown in FIG. 2, the stabilization assembly 34 can be mounted at the front end of the work platform 32, and the stabilization assembly 34 can be arranged on a front side of the first drilling frame assembly 33. The stabilization assembly 34 may be a telescopic oil cylinder. When the first drilling frame assembly 33 switches to the bolt support position, the stabilization assembly 34 can extend and be pressed against and in contact with a top side of the cutting device 2, thereby temporarily supporting the front end of the work platform 32, and avoiding a situation that the work platform 32 overhanging forward for a long time. On the one hand, a problem that the work platform 32 tends to be bent and deformed can be avoided; on the other hand, vibration of the first drilling frame assembly 33 during bolt support operations can be reduced, realizing a structural stabilization function.

It should be noted that in other embodiments, the stabilization assembly 34 may also be pressed against and in contact with the tunnel roof, or the stabilization assembly 34 may also be pressed against and in contact with the tunnel roof and the cutting device 2 at the same time. In other embodiments, the stabilization assembly 34 may also be pressed against and in contact with a lateral wall of the tunnel, thereby performing the bolt support operations on the lateral wall of the tunnel.

It can be understood that when adjusting the avoidance position and the bolt support position of the first drilling frame assembly 33, the position of the first drilling frame assembly 33 can be adjusted by cooperation between the lifting assembly 31 and the work platform 32. For example, when there is a foreign object under the cutting drum 21 and the cutting arm cannot swing to the lowest position, the work platform 32 can be lifted by the lifting assembly 31 to a position that matches the height of the cutting drum 21, then the work platform 32 can be extended forward, and the stabilization assembly 34 is pressed against and in contact with the cutting device 2.

During tunneling, the bolter miner 100 can adopt two operation methods, i.e., parallel operation and non-parallel operation. The parallel operation means that tunneling and bolt support operations are performed simultaneously. During operation, the first drilling frame assembly 33 needs to be withdrawn to a safe position. At this time, the cutting device 2 can perform cutting operations in front, and the first drilling frame assembly 33 can perform bolt support operations behind the cutting device 2. The parallel operation method is suitable for tunnel roofs in good conditions, in which case there may be a certain unsupported roof distance between the tunnel heading face and the bolt support position.

The non-parallel operation means that tunneling and bolt support operations are performed alternately. During the non-parallel operation, cutting feed into the coal wall is first completed by the cutting drum 21; then, the cutting drum 21 can be swung to the bottom through the cutting arm; and the first drilling frame assembly 33 can be moved above the cutting drum 21 through the lifting assembly 31 and the work platform 32, thereby completing the bolt support operation. The non-parallel operation method is suitable for tunnel roofs in poor conditions. After the heading face is advanced by one footage, the tunnel roof close to the heading face can get support timely, and the unsupported roof distance at the heading face can be shortened, avoiding collapse of the tunnel roof, and improving the safety of tunneling operations.

The bolter miner 100 according to embodiments of the present disclosure can realize the parallel and non-parallel operations of tunneling and bolt support. Based on different tunnel roof conditions, corresponding tunneling methods can be selected in a targeted manner, which can improve the flexibility during the tunneling process and help to ensure the tunneling safety and efficiency.

Moreover, in the non-parallel operation, the tunnel roof close to the heading face can get bolt support, avoiding the existence of large unsupported roof distance at the heading face, and ensuring the safe tunneling under poor conditions of the tunnel roof.

In addition, due to the presence of the stabilization assembly 34 that can provide effective support during bolt support operations, the structural stability during the bolt support operations can be guaranteed.

In some embodiments, the bolt support device 3 includes a first bolt support device 301 and a second bolt support device 302. The first bolt support device 301 and the second bolt support device 302 are spaced along a width direction of the rack 1. The first bolt support device 301 is suitable for bolt support operations on one side of the tunnel, and the second bolt support device 302 is suitable for bolt support operations on the other side of the tunnel. The first bolt support device 301 and the second bolt support device 302 can perform staggered bolt support operations in the length direction of the rack 1.

Figure 3:
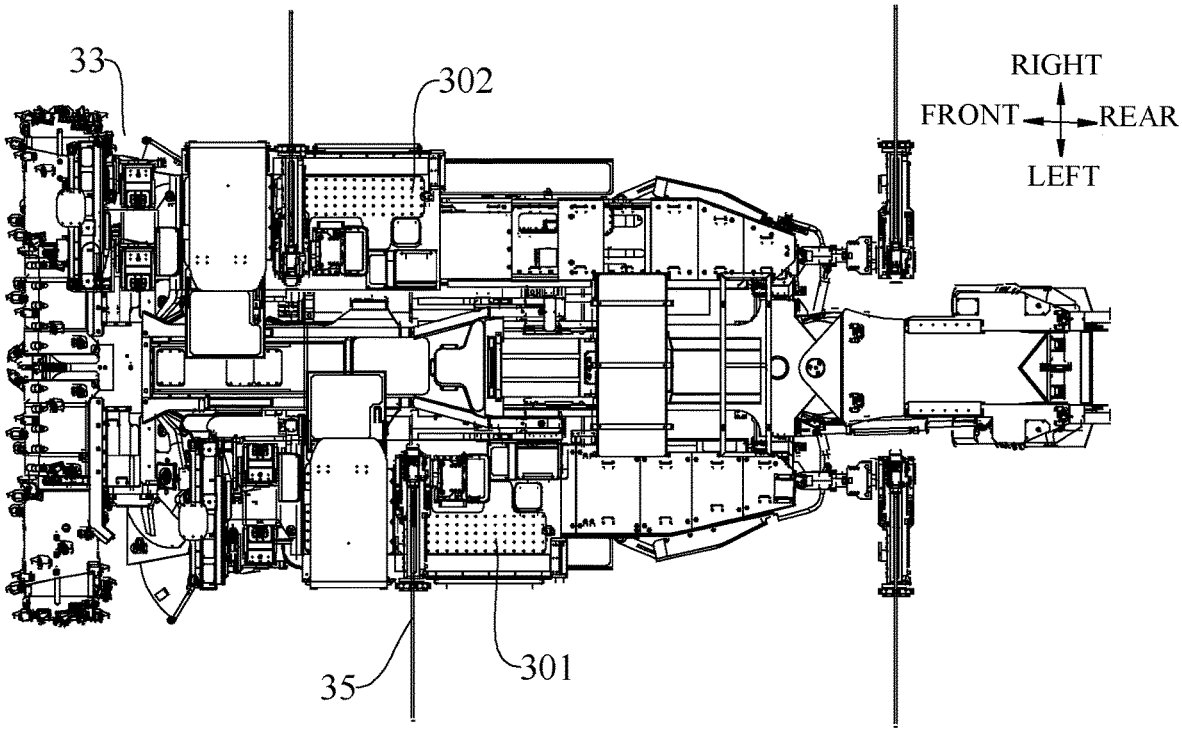
FIG. 3 is a top view of the bolter miner in FIG. 1.
Figure 5:
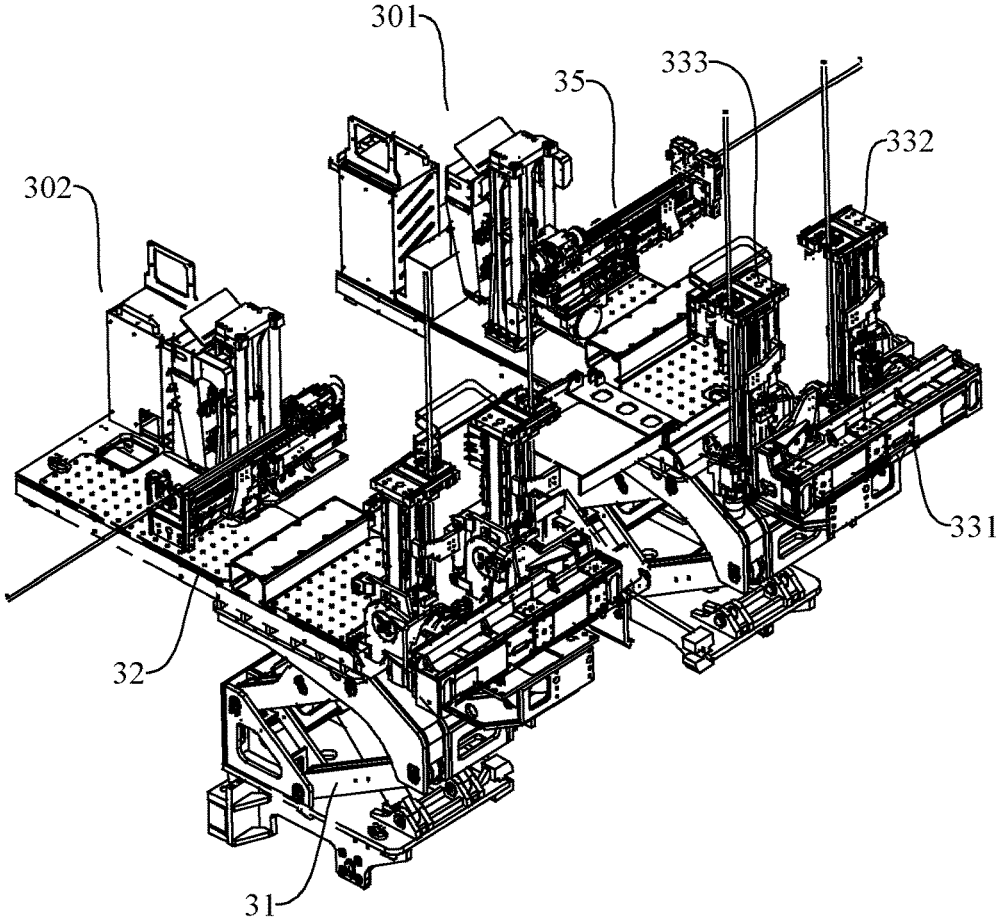
FIG. 5 is a schematic view of a bolt support device of the bolter miner in FIG. 1.
Figure 6:
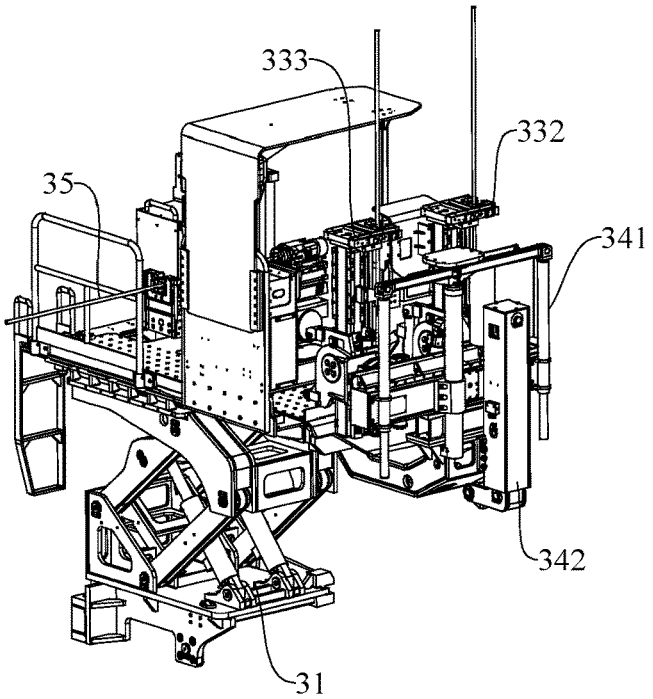
FIG. 6 is a schematic view of a single bolt support device in FIG. 5.

Specifically, as shown in FIGS. 3 and 5, there are two bolt support devices 3, namely, the first bolt support device 301 and the second bolt support device 302, arranged in parallel and spaced apart from each other in a left-right direction (i.e., the width direction of the rack 1). The first bolt support device 301 can be mounted on a left side of the rack 1, and the first bolt support device 301 mainly performs bolt support operations on the roof and lateral wall on the left side of the tunnel. The second bolt support device 302 can be mounted on a right side of the rack 1, and the second bolt support device 302 mainly performs bolt support operations on the roof and lateral wall on the right side of the tunnel.

On the one hand, the first bolt support device 301 and the second bolt support device 302 can simultaneously perform bolt support operations on the tunnel, which can enhance the bolt support efficiency. On the other hand, the conveying trough device 5 can be arranged between the first bolt support device 301 and the second bolt support device 302, which facilitates the installation of the conveying trough device 5 and avoids a situation that a single bolt support device 3 easily interfere with the conveying trough device 5 when the bolt support device 3 moves left or right.

It can be understood that in other embodiments, there is only one bolt support device 3. In this case, the bolt support device 3 can perform bolt support operations on the roof and lateral walls on both sides of the tunnel.

It should be noted that as shown in FIG. 3, the first drilling frame assembly 33 of the first bolt support device 301 and the first drilling frame assembly 33 of the second bolt support device 302 can be spaced apart from each other in the front-rear direction (i.e., a staggered arrangement), so that the bolt support operations on both sides can be spatially staggered, avoiding a situation of limited work space during operation at a common width section, and further improving the flexibility of bolt support operations.

In some embodiments, the first drilling frame assembly 33 includes a mounting seat 331 and an anchor drill. The mounting seat 331 is arranged on the work platform 32. The anchor drill is arranged on the mounting seat 331. The position of the anchor drill relative to the mounting seat 331 in the width direction of the rack 1 is adjustable, and the anchor drill is rotatable relative to the mounting seat 331.

Specifically, as shown in FIG. 5, the mounting seat 331 may be rectangular. The mounting seat 331 can be fixed to the front end of the work platform 32 through bolts and other fasteners. The mounting seat 331 extends in the left-right direction. The anchor drill, i.e., a roof bolter, can be guided and assembled on the mounting seat 331. For example, the anchor drill can be guided and assembled with the mounting seat 331 through a guide groove and a slider. Therefore, the anchor drill can slide left and right on the mounting seat 331, allowing for bolt support at different tunnel width positions.

The anchor drill can be rotatably connected to the mounting seat 331 through swing drive, so that the anchor drill can swing in the left-right direction and perform bolt support operations on both the roof and lateral walls of the tunnel, improving the flexibility in use of the anchor drill.

In some embodiments, the mounting seat 331 includes a first seat 3311 and a second seat 3312. The first seat 3311 and the second seat 3312 extend along the width direction of the rack 1. The first seat 3311 is arranged on the rack 1, and the second seat 3312 is arranged on the first seat 3311. The position of the second seat 3312 relative to the first seat 3311 in the width direction of the rack 1 is adjustable. The anchor drill includes a first anchor drill 332 and a second anchor drill 333. The first anchor drill 332 and the second anchor drill 333 are arranged on the second seat 3312, and the position of at least one of the first anchor drill 332 and the second anchor drill 333 is adjustable relative to the second seat 3312 in the width direction of the rack 1.

Figure 12:
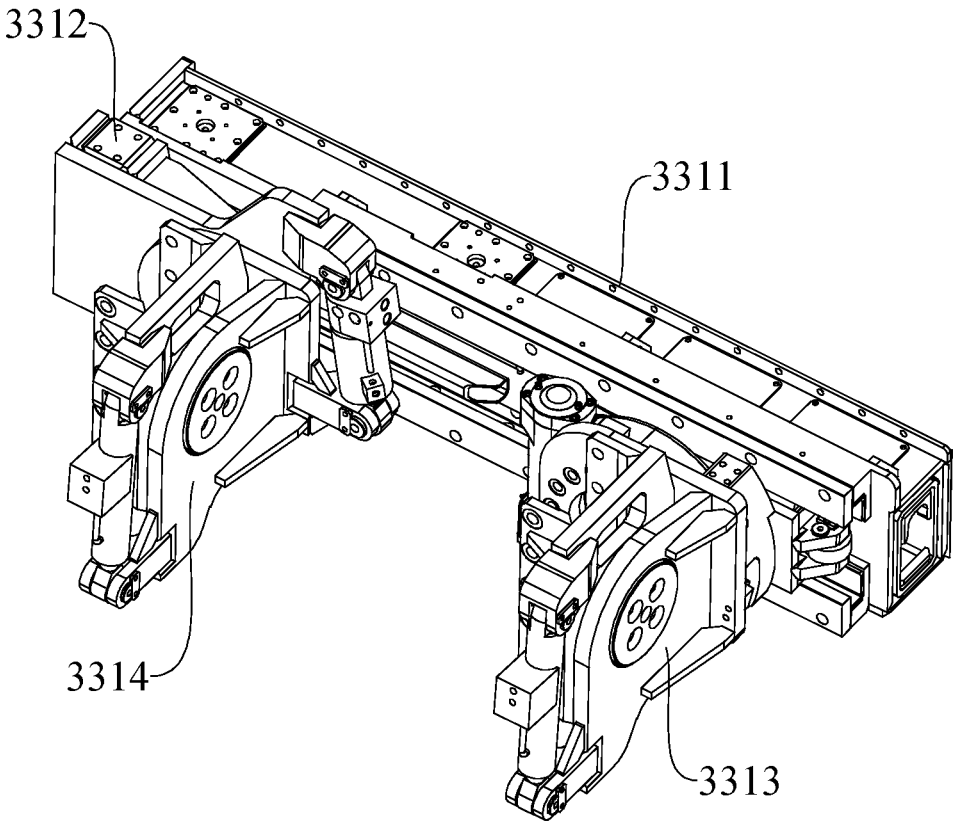
FIG. 12 is a structural schematic view of a mounting seat of a first drilling frame assembly in FIG. 6.
Figure 13:
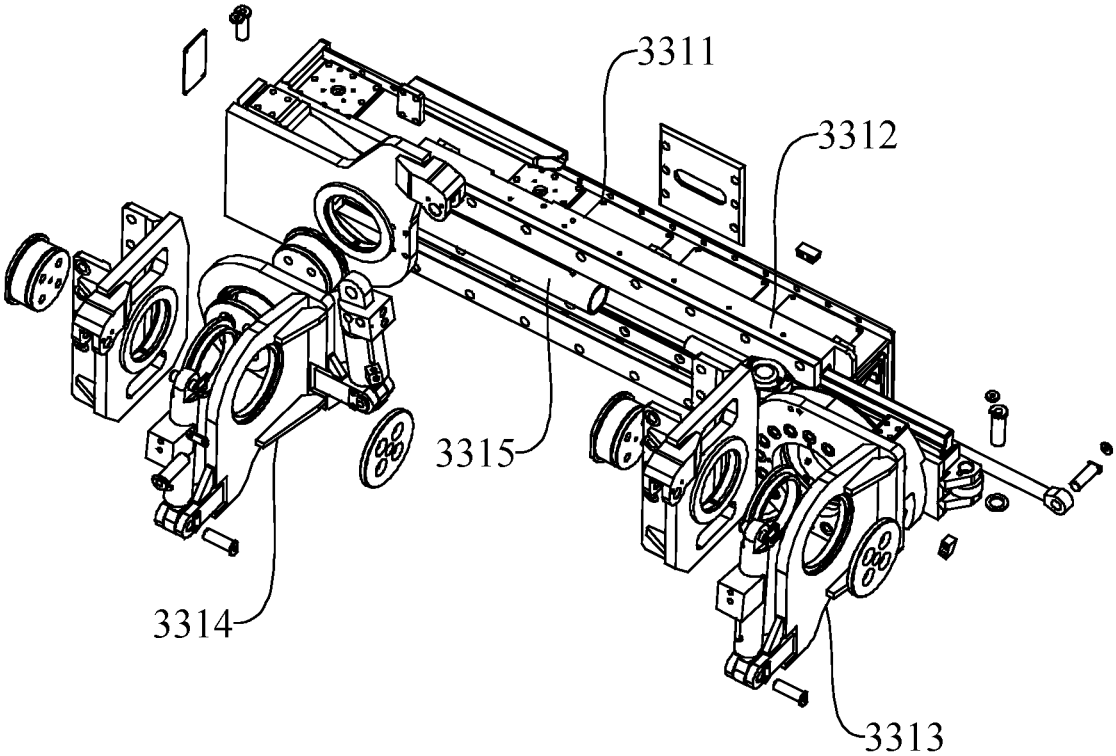
FIG. 13 is an exploded view of the mounting seat in FIG. 12.
Figure 14:
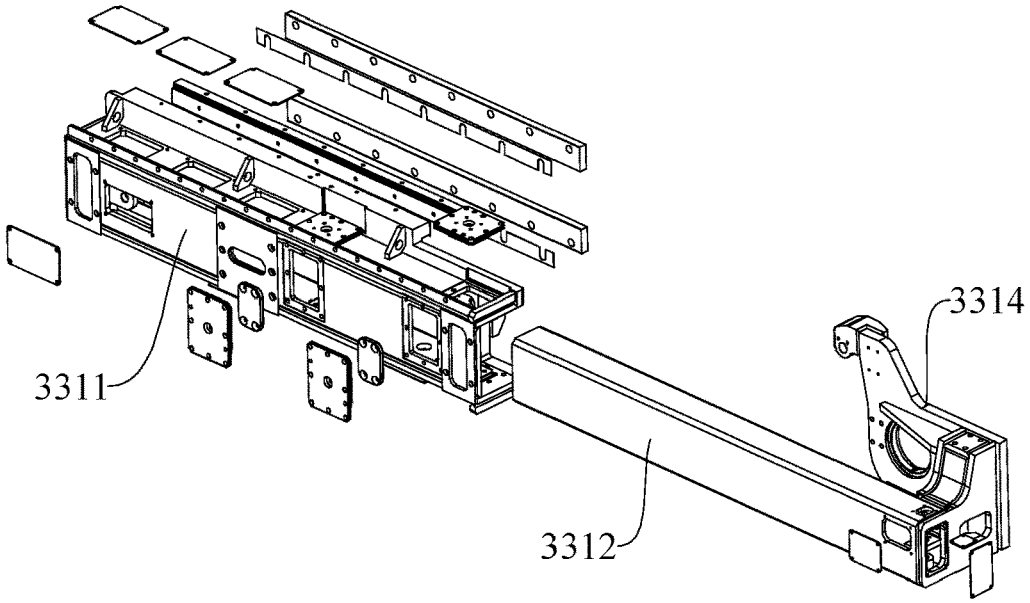
FIG. 14 is a structural schematic view of a first seat and a second seat in FIG. 12.

Specifically, as shown in FIGS. 12 to 14, the first seat 3311 may be in the shape of a square cylinder, and the second seat 3312 may be in the shape of a rectangular parallelepiped. The second seat 3312 is fitted in the first seat 3311 and is movable along an extension direction of the first seat 3311. There may be a hydraulic telescopic cylinder in the first seat 3311, and the hydraulic telescopic cylinder can drive relative positions of the first seat 3311 and the second seat 3312.

There may be two anchor drills, namely, the first anchor drill 332 and the second anchor drill 333. The first anchor drill 332 and the second anchor drill 333 are both assembled on the second seat 3312. Therefore, when the second seat 3312 shifts in the left-right direction, the first anchor drill 332 and the second anchor drill 333 will also shift synchronously, thus achieving the adjustment of positions of the first anchor drill 332 and the second anchor drill 333 in the left-right direction.

As shown in FIG. 13, the first anchor drill 332 can be arranged on an outer side of the second anchor drill 333 (i.e., a side close to the lateral wall of the tunnel), the second anchor drill 333 can be fixed at an end of the second seat 3312, and the first anchor drill 332 can be assembled on the second seat 3312 in a guided sliding manner. That is, the position of the second anchor drill 333 along an extension direction of the second seat 3312 is not adjustable, and the position of the first anchor drill 332 along the extension direction of the second seat 3312 is adjustable. Therefore, the second anchor drill 333 is mainly used for bolt support operations on the tunnel roof, and the first anchor drill 332 is mainly used for bolt support operations on the lateral walls of the tunnel.

As shown in FIG. 13, a first drill block 3313 and a second drill block 3314 are arranged on the second seat 3312. The first anchor drill 332 can be connected to the second seat 3312 through the first drill block 3313, and the second anchor drill 333 can be connected to the second seat 3312 through the second drill block 3314. The first drill block 3313 is assembled with the second seat 3312 in a guided manner. A drill block driver 3315 is arranged between the second seat 3312 and the first drill block 3313. The drill block driver 3315 has a first end hinged with the second seat 3312 and a second end hinged with the first drill seat 3313, so that the adjustment of the position of the first anchor drill 332 can be achieved through the drill block driver 3315. It can be understood that in other embodiments, both the first anchor drill 332 and the second anchor drill 333 can be assembled on the second seat 3312 in a guided manner.

The first drill block 3313 and the second drill block 3314 can be swing-driven, so that both the first drill block 3313 and the second drill block 3314 can swing in the left-right direction, facilitating the adjustment of anchor rod installation directions.

During the operation, the position of the second seat 3312 can be adjusted by a corresponding driver, and hence the adjustment of the position of the second anchor drill 333 can be achieved. The position of the second seat 3312 can be adjusted by the corresponding driver, and then the position of the first anchor drill 332 can be adjusted by the drill block driver 3315, thereby achieving the adjustment of the position of the first anchor drill 332 in the left-right direction, improving the adaptability to different widths of tunnels.

In some embodiments, in the width direction of the rack 1, the first anchor drill 332 is arranged on an outer side of the second anchor drill 333; the second anchor drill 333 is arranged on the second seat 3312 and rotatable in the length direction and/or the width direction of the rack 1; the first anchor drill 332 is arranged on the second seat 3312 and is adjustable in terms of its position relative to the second seat 3312 in the width direction of the rack 1; and the first anchor drill 332 is rotatable in the length direction and/or the width direction of the rack 1.

Specifically, as shown in FIG. 13, the first drill block 3313 can have two rotation axes, one of which extends in the front-rear direction, and the other of which extends in the left-right direction. Therefore, the first anchor drill 332 can swing in both the left-right direction (the width direction of the rack 1) and the front-rear direction (the length direction of the rack 1), further improving the flexibility in adjusting the anchor rod installation direction, and facilitating bolt support construction operations with different tilt angles.

In some embodiments, in the length direction of the rack 1, the stabilization assembly 34 is arranged on an outer side of the first drilling frame assembly 33; a first blocking member 326 is connected between the second seat 3312 and the stabilization assembly 34; and the first blocking member 326 is configured to unfold to block the coal rock during movement of the second seat 3312.

Figure 15:
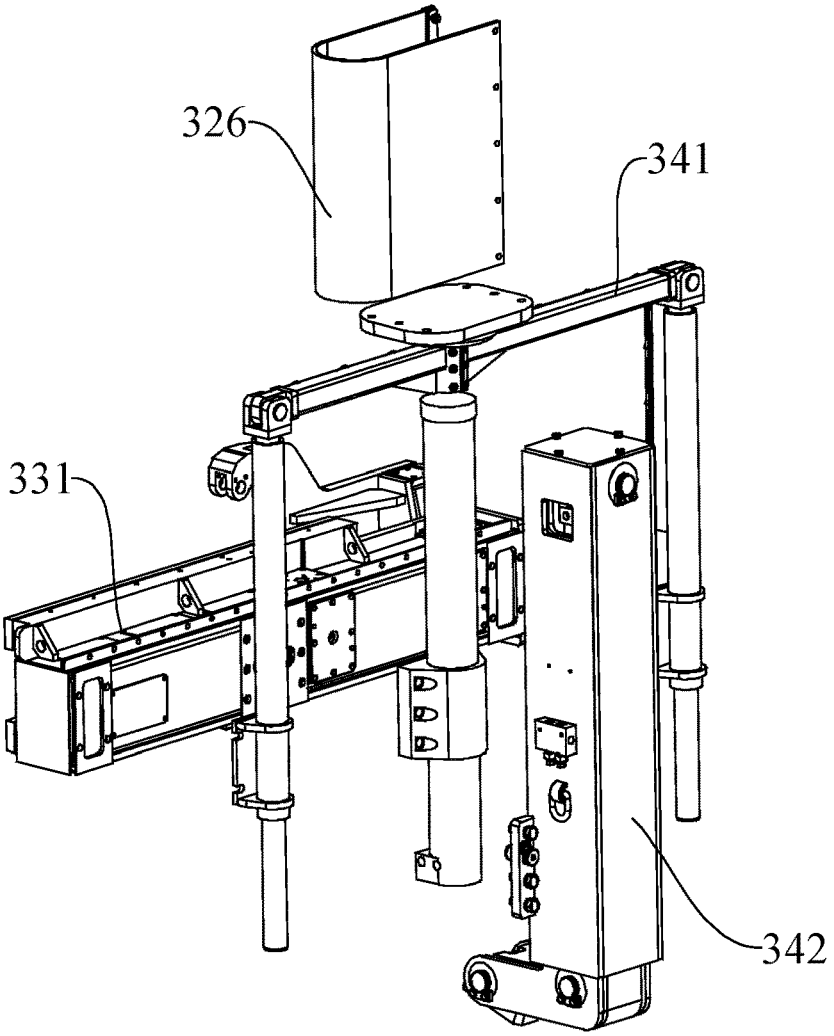
FIG. 15 is a structural schematic view of a stabilization assembly in FIG. 6.

Specifically, as shown in FIG. 15, the stabilization assembly 34 is arranged on the front side of the first drilling frame assembly 33. The first blocking member 326 may be a piece of rubber, and one side of the first blocking member 326 is fixedly connected to the second seat 3312 and the other side of the first blocking member 326 is fixedly connected to the stabilization assembly 34. When the second seat 3312 slides in the left-right direction, the second seat 3312 will stretch and unfold the first blocking member 326, so that the first blocking member 326 will block the front side of the first drilling frame assembly 33, avoiding a situation that coal rock falls on the equipment and operators, and playing a protection role.

In some embodiments, the stabilization assembly 34 includes a first support assembly 341 and a second support assembly 342. The first support assembly 341 and the second support assembly 342 are arranged on the work platform 32. The first support assembly 341 can extend upwards and is adapted to support the tunnel roof. The second support assembly 342 can extend downwards and is adapted to support the cutting device 2.

Specifically, as shown in FIG. 15, both the first support assembly 341 and the second support assembly 342 can be detachably mounted on the front end of the work platform 32 through fasteners such as bolts. Both the first support assembly 341 and the second support assembly 342 may be hydraulic telescopic cylinders, in which the first support assembly 341 can extend upwards and support the tunnel roof, and the second support assembly 342 can extend downwards and support the cutting device 2. On the one hand, the arrangement of the first support assembly 341 and the second support assembly 342 enhances the structural stability during the bolt support operation; on the other hand, the first support assembly 341 and the second support assembly 342 can operate independently, improving the support reliability.

In some embodiments, the first support assembly 341 includes a first support driver 3411, a crossbar 3412, and a second blocking member (not shown). The first support driver 3411 is connected to the work platform 32, and a free end of the first support driver 3411 is configured to support the tunnel roof. The crossbar 3412 is connected to the free end of the first support driver 3411. The second blocking member is connected between the crossbar 3412 and the work platform 32 and is configured to unfold to block the coal rock when the first support driver 3411 provides support.

Figure 16:
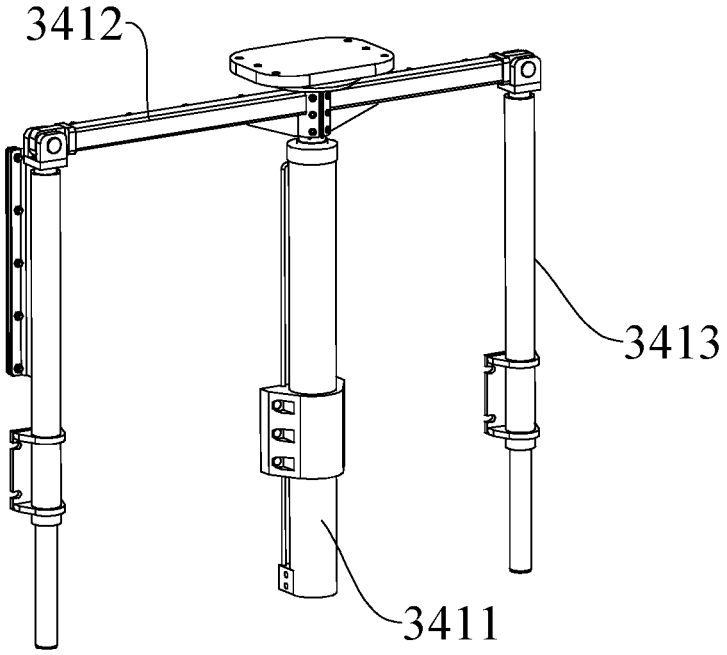
FIG. 16 is a structural schematic view of a first support assembly in FIG. 15.

Specifically, as shown in FIG. 16, the first support driver 3411 can be a hydraulic telescopic cylinder, and the first support driver 3411 extends in the up-down direction. A top end of the first support driver 3411 is configured to support the tunnel roof. The crossbar 3412 is fixed at the top of the first support driver 3411, and extends in the left-right direction. The second blocking member may be a chain curtain, and has a top end connected to the crossbar 3412 and a bottom end connected to the first seat 3311. Therefore, when the first support driver 3411 extends, the second blocking member can be unfolded under the drive of the crossbar 3412, and hence block the first drilling frame assembly 33, to further protect the equipment and operators.

Optionally, as shown in FIG. 16, the top end of the first support driver 3411 is provided with a support top plate that may be a rectangular plate. The support top plate can increase an action area with the tunnel roof, and enhance the stabilization effect.

It can be understood that in other embodiments, the second blocking member may also be a flexible blocking member such as a piece of rubber.

In some embodiments, the first support assembly 341 includes a plurality of guide rods 3413 that are spaced along an extension direction of the crossbar 3412. The guide rods 3413 are connected between the crossbar 3412 and the work platform 32, and the guide rods 3413 are configured to limit a driving direction of the first support driver 3411.

Specifically, as shown in FIG. 16, there may be two guide rods 3413, and the first support driver 3411 can be arranged in the middle of the two guide rods 3413. One of the two guide rods 3413 has a top end connected to a first end of the crossbar 3412 and a bottom end connected to the first seat 3311. The other guide rod 3413 has a top end connected to a second end of the crossbar 3412 and a bottom end connected to the first seat 3311. The guide rods 3413 can include an inner rod and an outer rod. The outer rod is fixed on the first seat 3311, and the inner rod is fitted in the outer rod in a guided manner. The guide rods 3413 play a guiding rode and enhance the structural strength.

Optionally, the first blocking member 326 can be fixedly connected to the outer rod.

In some embodiments, the second support assembly 342 includes a support inner cylinder 3422, a support outer cylinder 3421, and a second support driver 3424. The support outer cylinder 3421 is arranged on the work platform 32. The support inner cylinder 3422 is fitted within the support outer cylinder 3421, and the support inner cylinder 3422 is slidable relative to the support outer cylinder 3421. The second support driver 3424 is arranged within the support outer cylinder 3421, and has a first end connected to the support outer cylinder 3421 and a second end connected to the support inner cylinder 3422. The second support driver 3424 is configured to drive movement of the support inner cylinder 3422 to enable the second support assembly 342 to support the cutting device 2.

Figure 17:
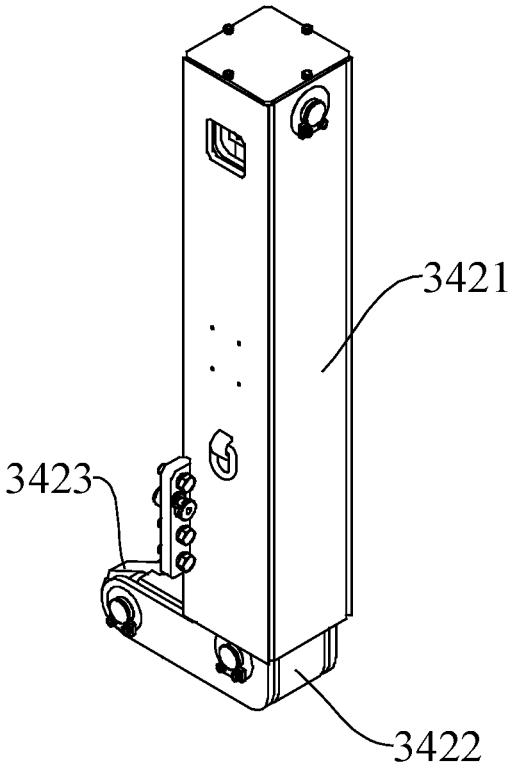
FIG. 17 is a structural schematic view of a second support assembly in FIG. 15.
Figure 18:
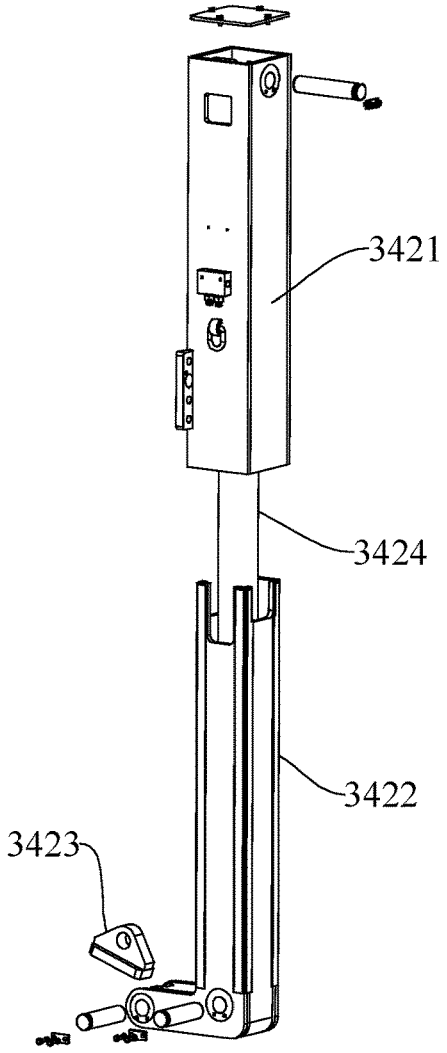
FIG. 18 is an exploded view of the second support assembly in FIG. 17.

Specifically, as shown in FIGS. 17 and 18, both the support inner cylinder 3422 and the support outer cylinder 3421 are square cylinders. The support outer cylinder 3421 is fixed on a front side of the work platform 32 or a front side of the first seat 3311, and the support inner cylinder 3422 is fitted within the support outer cylinder 3421. The second support driver 3424 may be a hydraulic telescopic cylinder, and the second support driver 3424 can be arranged within the support outer cylinder 3421. A top end of the second support driver 3424 is connected to the support outer cylinder 3421, and a bottom end of the second support driver 3424 is connected to the support inner cylinder 3422. The downward movement of the support inner cylinder 3422 can be achieved through extension of the second support driver 3424, and hence support between a bottom end of the support inner cylinder 3422 and the cutting device 2 can be realized.

Since the second support driver 3424 is arranged within the support outer cylinder 3421, the second support driver 3424 only needs to bear an axial force when in use, while a shear force is mainly borne by the support inner cylinder 3422 and the support outer cylinder 3421. Thus, the structural strength of the second support assembly 342 is enhanced and the structural stability and strength is ensured.

In some embodiments, the second support assembly 342 includes a pressure block 3423 rotatably connected to a free end of the support inner cylinder 3422. The pressure block 3423 has a fitting surface, and the pressure block 3423 is configured to rotate to make the fitting surface and the cutting device 2 fit together when the cutting device 2 is supported by the second support assembly 342.

Specifically, as shown in FIGS. 17 and 18, the pressure block 3423 may be a triangular block and can be rotatably connected to the bottom end of the support inner cylinder 3422 through a pivot shaft. A bottom surface of the pressure block 3423 forms the fitting surface, and the fitting surface of the pressure block 3423 is always located below under the action of gravity. When the second support assembly 342 extends, the pressure block 3423 can come into contact with the cutting device 2, and the pressure block 3423 can rotate on its own under a fitting effect of the cutting device 2, so that the fitting surface of the pressure block 3423 can fully fit with the cutting device 2. The arrangement of the pressure block 3423 not only enhances a friction area, enhancing the stabilization effect, but also has a buffering effect, slowing down transmission of impact force during bolt support operations.

In some embodiments, the cutting device 2 is provided with a support top 22, and the support top 22 extends along the length direction of the rack 1 to meet support for the pressure block 3423 after the work platform 32 is adjusted to different expansion and retraction amounts.

Specifically, as shown in FIG. 4, the support top 22 can be integrated with the cutting device 2. The support top 22 is in a long strip shape, and the support top 22 extends roughly in the front-rear direction. When the second support assembly 342 extends, the pressure block 3423 of the second support assembly 342 can be pressed against the support top 22, thereby achieving the support between the second support assembly 342 and the cutting device 2.

Since the support top 22 has a size extending in the front-rear direction, when the work platform 32 is adjusted to different expansion and retraction amounts, the pressure block 3423 can still be pressed on the support top 22, meeting operation requirements of different expansion and retraction amounts of the work platform 32, thereby enabling the first drilling frame assembly 33 to meet the requirements of anchor rod installation with different row spacing.

Optionally, a top surface of the support top 22 is used to fit with the fitting surface of the pressure block 3423, and the top surface of the support top 22 tilts downwards from the rear to the front. As a result, a force acting on the support top 22 generates a backward component force, and a center of gravity of the bolter miner 100 is on the rear side where a significant frictional effect exists, so that the component force can be effectively counteracted and the stability of the bolt support operations can be ensured.

In some embodiments, the support inner cylinder 3422 includes an inner cylinder section and an extension section. The inner cylinder section is fitted within the support outer cylinder 3421 in a guided manner, and the extension section is arranged at a free end of the inner cylinder section and at an angle with the inner cylinder section. The extension section extends towards one side of the rack 1, and the pressure block 3423 is rotatably connected to a free end of the extension section.

Specifically, as shown in FIGS. 17 and 18, the inner cylinder section extends in the up-down direction; the extension section extends in the front-rear direction; a front end of the extension section is connected to a bottom end of the inner cylinder section; and the pressure block 3423 is rotatably assembled at a rear end of the extension section. Therefore, when the front end of the work platform 32 extends to a front side of the cutting drum 21, the pressure block 3423 can still be located above the cutting device 2 and achieve support with the cutting device 2. The arrangement of the extension section can increase a forward displacement of the work platform 32, thereby increasing an operation range of the first drilling frame assembly 33.

In some embodiments, the first support assembly 341 includes a plurality of third support drivers 3414 and a ceiling panel 3415. The plurality of third support drivers 3414 are arranged in parallel and spaced apart from each other. Each third support driver 3414 has a first end connected to the work platform 32 and a second end rotatably connected to the ceiling panel 3415. The ceiling panel 3415 is configured to support the tunnel roof through the extension of the plurality of third support drivers 3414, and the ceiling panel 3415 can achieve inclination adjustment by adjusting the plurality of third support drivers 3414 to different expansion and retraction amounts.

Figure 21:
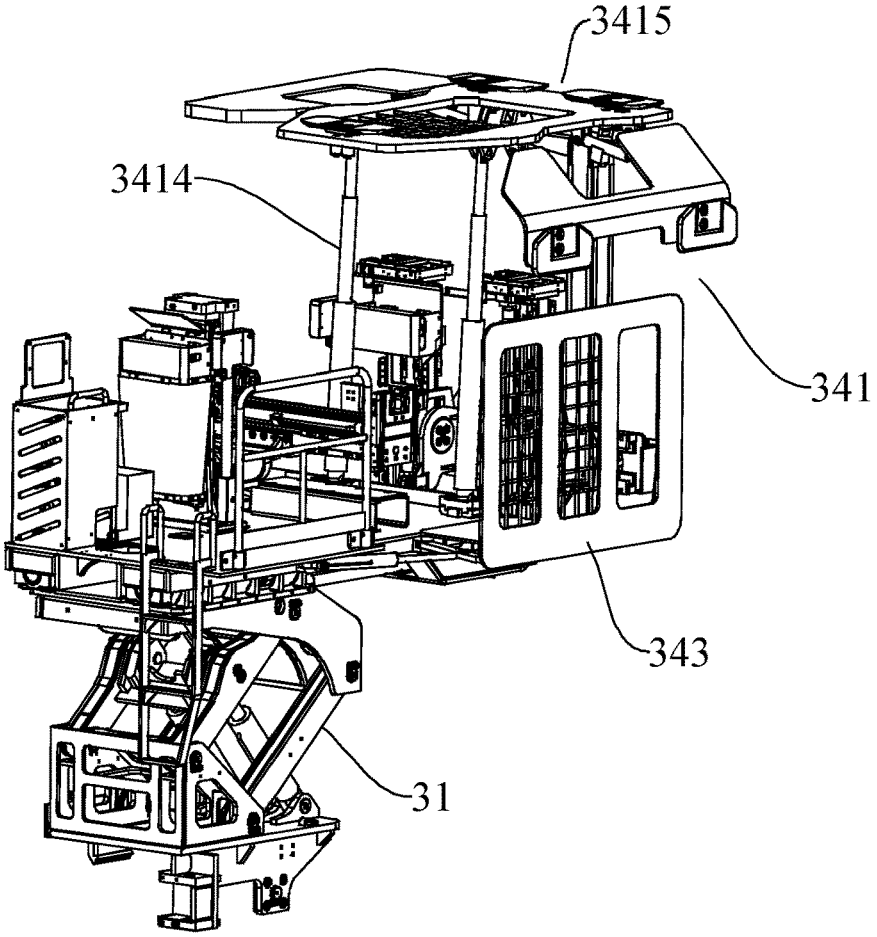
FIG. 21 is a structural schematic view of a stabilization assembly according to another embodiment of the present disclosure.

Specifically, as shown in FIG. 21, each third support driver 3414 may be a hydraulic telescopic oil cylinder, and there may be three third support drivers 3414, one of which is arranged on the front side of the work platform 32, and the remaining two are arranged on the rear side and arranged in parallel and spaced apart from each other along the left-right direction. Respective bottom ends of the three third support drivers 3414 can all be fixedly connected to the work platform 32, and for example, they can be mounted and fixed by bolts. Consequently, the third support drivers 3414 can be prevented from swinging and only be allowed for telescopic movement in the up-down direction.

A top end of the third support driver 3414 can be hinged with or pivotally connected to the ceiling panel 3415, thereby allowing the ceiling panel 3415 to swing relative to the third support driver 3414. During use, by controlling synchronous extension of the three third support drivers 3414, the ceiling panel 3415 can be lifted, allowing the ceiling panel 3415 to support the tunnel roof. When the tunnel roof is inclined or uneven, the three third support drivers 3414 can be adjusted to different expansion and retraction amounts, thereby making the ceiling panel 3415 inclined and improving its adaptability to the tunnel roof.

Optionally, the three third support drivers 3414 can be all connected to the ceiling panel 3415 through pivot shafts, and all three pivot shafts extend in the left-right direction, so that the ceiling panel 3415 can be inclined and adjusted in the front-rear direction.

In some embodiments, the ceiling panel 3415 includes a main ceiling 34151, an inner ceiling 34152, and an outer ceiling 34153. The plurality of third support drivers 3414 are connected to the main ceiling 34151. The inner ceiling 34152 is rotatably connected to the main ceiling 34151 and arranged on an inner side of the main ceiling 34151. A first ceiling driver 3416 is arranged between the inner ceiling 34152 and the main ceiling 34151, and the first ceiling driver 3416 is configured to provide inclined support for the inner ceiling 34152 to realize the up-and-down swing of the inner ceiling 34152. The outer ceiling 34153 is rotatably connected to the main ceiling 34151 and is arranged on an outer side of the main ceiling 34151. A second ceiling driver 3417 is arranged between the outer ceiling 34153 and the main ceiling 34151, and the second ceiling driver 3417 is configured to provide inclined support for the outer ceiling 34153 to realize the up-and-down swing of the outer ceiling 34153.

Figure 22:
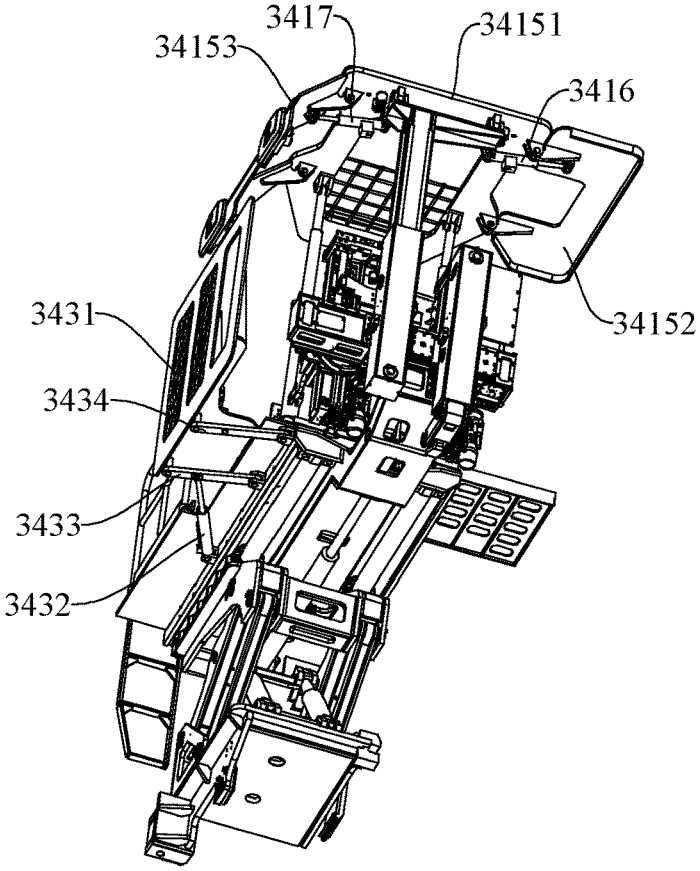
FIG. 22 is a bottom perspective view of the stabilization assembly in FIG. 21.
Figure 23:
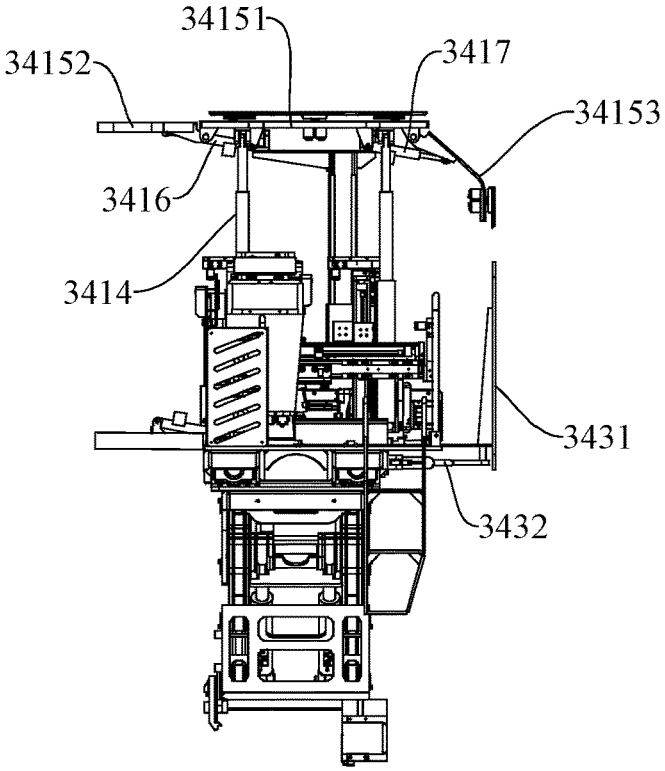
FIG. 23 is a rear view of the stabilization assembly in FIG. 21.
Figure 24:
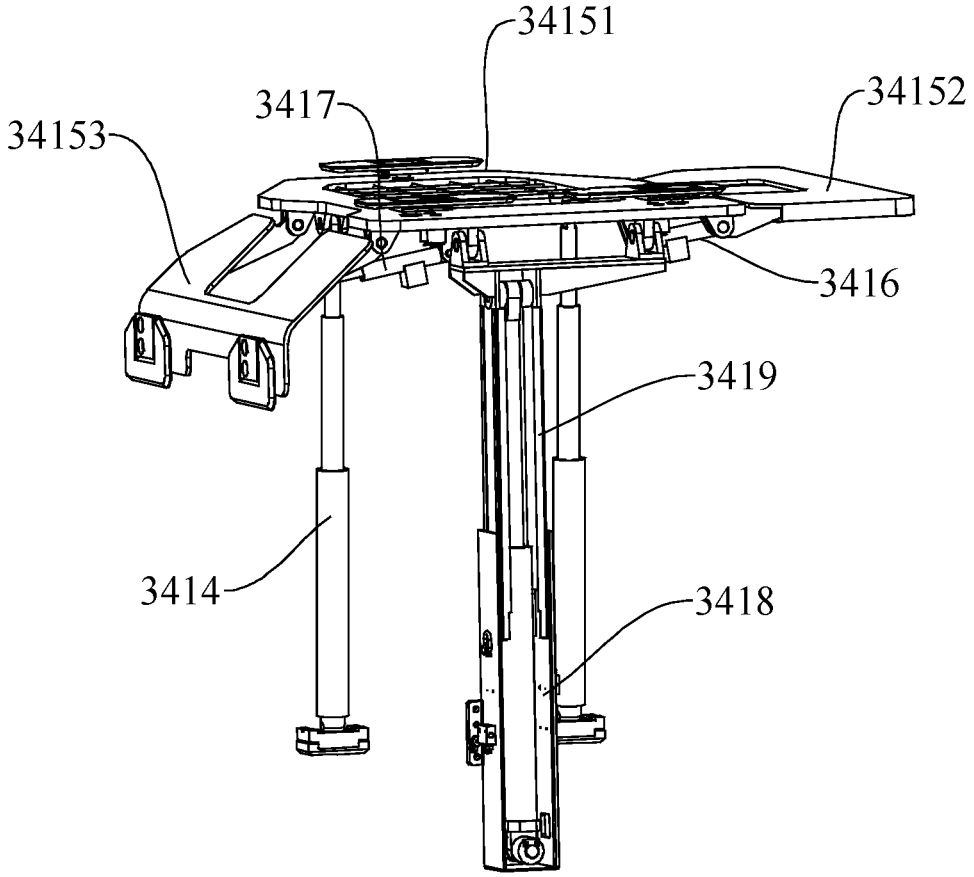
FIG. 24 is a structural schematic view of a first support assembly in FIG. 21.

Specifically, as shown in FIGS. 22 to 24, the inner ceiling 34152 can be pivotally assembled on the inner side of the main ceiling 34151 through a pivot shaft. The first ceiling driver 3416 can be arranged below the main ceiling 34151 and the inner ceiling 34152. A first end of the first ceiling driver 3416 can be hinged with the main ceiling 34151, and a second end thereof can be hinged with the inner ceiling 34152. The up-and-down swing of the inner ceiling 34152 can be realized by the first ceiling driver 3416. The outer ceiling 34153 can be pivotally assembled on the outer side of the main ceiling 34151 through a pivot shaft. The second ceiling driver 3417 can be arranged below the main ceiling 34151 and the outer ceiling 34153. A first end of the second ceiling driver 3417 can be hinged with the main ceiling 34151, and a second end thereof can be hinged with the outer ceiling 34153. The up-and-down swing of the outer ceiling 34153 can be achieved by the second ceiling driver 3417.

The arrangement of the inner ceiling 34152 and the outer ceiling 34153 can not only increase an action area between the first support assembly 341 and the tunnel roof, but also make the shape of the ceiling panel 3415 adjustable, thereby improving the adaptability of the ceiling panel 3415 to the tunnel roof. In addition, during the movement of the bolter miner, the ceiling panel 3415 can be retracted, thereby improving the trafficability.

In some embodiments, the first support assembly 341 includes a limiting outer cylinder 3418 and a limiting inner cylinder 3419. The limiting outer cylinder 3418 is connected to the work platform 32. The limiting inner cylinder 3419 is fit within the limiting outer cylinder 3418 in a guided sliding manner and connected to the ceiling panel 3415. The limiting outer cylinder 3418 and the limiting inner cylinder 3419 cover an outer side of the third support driver 3414 to limit a direction of expansion and retraction of the third support driver 3414 when the third support driver 3414 extends and retracts.

Specifically, as shown in FIG. 24, respective cross sections of the limiting outer cylinder 3418 and the limiting inner cylinder 3419 can both be square, so that anti-rotation assembly of the limiting inner cylinder 3419 and the limiting outer cylinder 3418 can be realized. The limiting outer cylinder 3418 can be connected to the front end of the work platform 32 through bolts, and the limiting outer cylinder 3418 extends in the up-down direction. The limiting inner cylinder 3419 is fitted within the limiting outer cylinder 3418 in the guided manner, and a top end of the limiting inner cylinder 3419 can be rotatably assembled with the main ceiling 34151. Therefore, the limiting inner cylinder 3419 can only move along an extension direction of the limiting outer cylinder 3418, thereby limiting the direction of expansion and retraction of the third support driver 3414. For example, when both upper and lower ends of the third support driver are rotatably assembled with the work platform 32 and the ceiling panel 3415, respectively, it is possible to prevent the third support driver from swinging.

As shown in FIG. 24, one third support driver 3414 can be mounted inside the limiting inner cylinder 3419 and the limiting outer cylinder 3418. A top end of the third support driver 3414 can be hinged with or pivotally assembled with the top of the limiting inner cylinder 3419, and a bottom end of the third support driver 3414 can be hinged with or pivotally assembled with the bottom of the limiting outer cylinder 3418. The limiting inner cylinder 3419 and the limiting outer cylinder 3418 can provide protection for the third support driver 3414.

In some embodiments, the stabilization assembly 34 includes a third support assembly 343, and the third support assembly 343 includes a lateral panel 3431 and a fourth support driver 3432. The fourth support driver 3432 is arranged between the work platform 32 and the lateral panel 3431, and the fourth support driver 3432 is configured to drive the lateral panel 3431 to move, so that the lateral panel 3431 can support the lateral wall of the tunnel.

Figure 25:
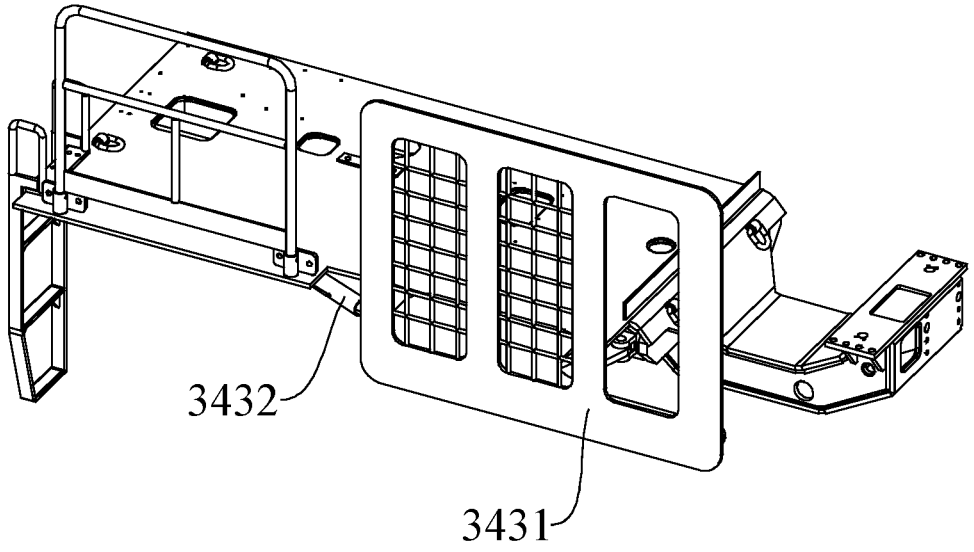
FIG. 25 is a structural schematic view of a third support assembly in FIG. 21.

Specifically, as shown in FIGS. 21 and 25, the fourth support driver 3432 may be a hydraulic telescopic oil cylinder, and an outer cylinder of the fourth support driver 3432 can be fixed with the work platform 32. The lateral panel 3431 can be fixed at a free end of the fourth support driver 3432, and the fourth support driver 3432 can extend in the left-right direction. The lateral panel 3431 can be driven to the left or to the right through the extension of the fourth support driver 3432, so that the lateral panel 3431 can support the lateral wall of the tunnel. The arrangement of the third support assembly 343 enhances an action fulcrum and further enhances the stability during bolt support operations.

In some embodiments, the third support assembly 343 includes a first connection rod 3433 and a second connection rod 3434. The first connection rod 3433 has a first end rotatably connected to the work platform 32 and a second end rotatably connected to the lateral panel 3431. The second connection rod 3434 has a first end rotatably connected to the work platform 32 and a second end rotatably connected to the lateral panel 3431. The first connection rod 3433 and the second connection rod 3434 are arranged in parallel and spaced apart from each other along the length direction of the rack. The fourth support driver 3432 has a first end connected to the work platform 32, and a second end connected to the first connection rod 3433 or the second connection rod 3434. The fourth support driver 3432 is configured to drive the first connection rod 3433 or the second connection rod 3434 to swing to move the lateral panel 3431.

Figure 26:
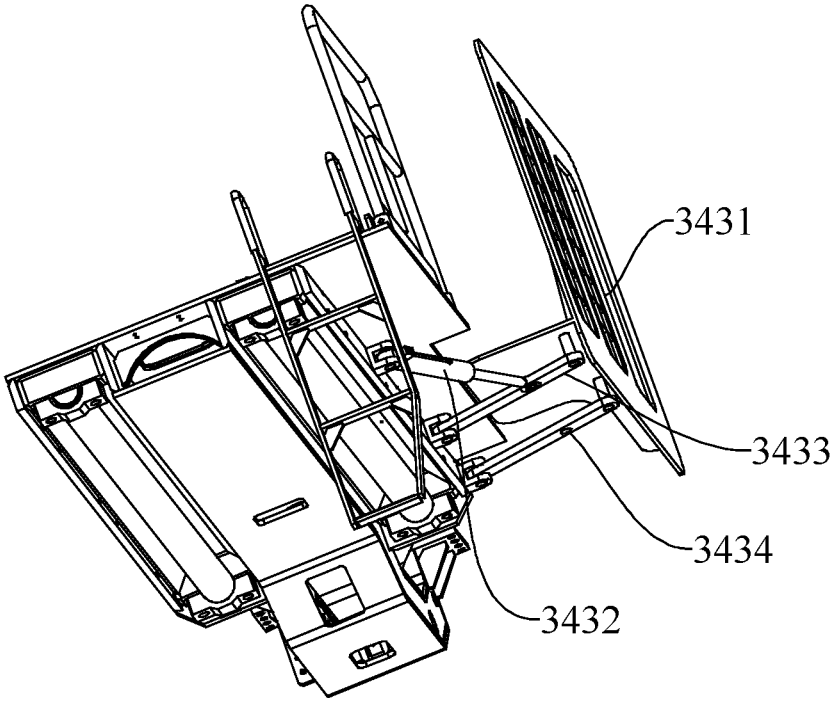
FIG. 26 is a bottom view of the third support assembly in FIG. 21.

Specifically, as shown in FIGS. 22 and 26, the first connection rod 3433 and the second connection rod 3434 are parallel and equal. Both ends of the first connection rod 3433 are hinged with the lateral panel 3431 and the work platform 32, respectively. Both ends of the second connection rod 3434 are hinged with the lateral panel 3431 and the work platform 32, respectively. A four-linkage mechanism is formed between the first connection rod 3433, the second connection rod 3434, the work platform 32, and the lateral panel 3431. The first end of the fourth support driver 3432 is hinged with the work platform 32, and the second end thereof is hinged with the first connection rod 3433. Through the expansion and retraction of the fourth support driver 3432, the swing drive of the first connection rod 3433 can be achieved, and hence the translation drive of the lateral panel 3431 can be realized.

In other embodiments, the first end of the fourth support driver 3432 can be hinged with the work platform 32, and the second end thereof can be hinged with the second connection rod 3434. The arrangement of the four-linkage mechanism ensures parallel movement of the lateral panel 3431, avoiding a situation of mechanism being locked, which is conducive to the retraction and support of the lateral panel 3431.

In some embodiments, the work platform 32 includes a first platform 322, a second platform 321, and a platform driver 323. The second platform 321 is arranged on the lifting assembly 31. The first platform 322 is arranged on the second platform 321, and the first platform 322 is slidable in the length direction of the rack 1 relative to the second platform 321. The platform driver 323 has a first end connected to the first platform 322 and a second end connected to the second platform 321. The platform driver 323 is configured to drive the first platform 322 to move, to achieve expansion and retraction of the work platform 32. The first drilling frame assembly 33 and the stabilization assembly 34 are arranged on the first platform 322.

Specifically, as shown in FIGS. 7 to 11, both the first platform 322 and the second platform 321 may be rectangular platforms, thereby enhancing a guiding effect of the work platform 32. The second platform 321 can be fixed at a top end of the lifting assembly 31. The first platform 322 can be assembled with the second platform 321 in a guided manner, and the first platform 322 can slide in the front-rear direction relative to the second platform 321. The platform driver 323 may be a telescopic hydraulic cylinder. A rear end of the platform driver 323 can be hinged with the second platform 321, and a front end of the platform driver 323 can be hinged with the first platform 322. The movement of the first platform 322 can be achieved through the extension of the platform driver 323. The first drilling frame assembly 33 and the stabilization assembly 34 can be both fixed at a front end of the first platform 322, and the movement of the first drilling frame assembly 33 and the stabilization assembly 34 can be achieved through the movement of the first platform 322.

Optionally, the first platform 322 and the second platform 321 are formed by welding steel plates.

In some embodiments, the first platform 322 includes a straight section 3222 and a bent section 3223. The straight section 3222 is assembled with the second platform 321 in a guided manner, and the bent section 3223 is connected to a free end of the straight section 3222. The bent section 3223 protrudes downwards and forms an avoidance groove above. The first drilling frame assembly 33 includes the mounting seat 331 and the anchor drill. The mounting seat 331 is arranged at a free end of the bent section 3223, and the anchor drill is arranged on the mounting seat 331. The position of the anchor drill relative to the mounting seat 331 in the width direction of the rack 1 is adjustable, and the avoidance groove is configured to avoid the anchor drill when the anchor drill moves along the width direction of the rack 1. The platform driver 323 is arranged below the work platform 32, and the first end of the platform driver 323 is connected to the bent section 3223.

Figure 10:
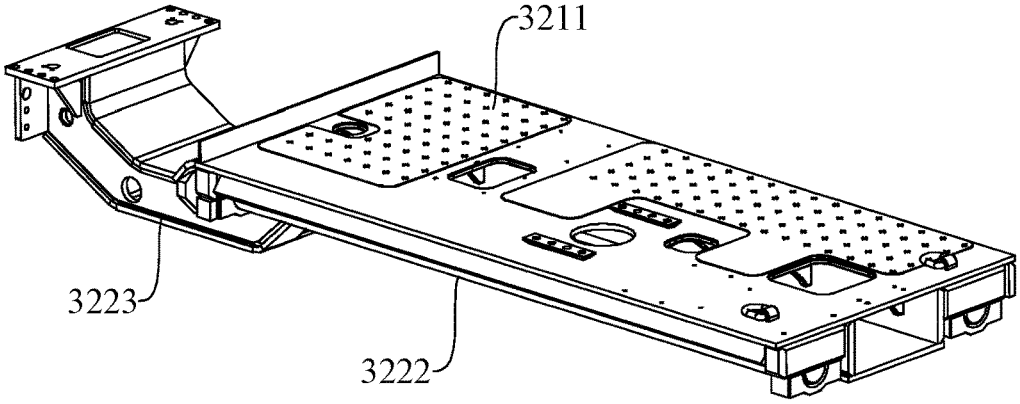
FIG. 10 is a schematic view of the work platform in FIG. 6.

Specifically, as shown in FIG. 10, the straight section 3222 is generally rectangular in shape, the bent section 3223 is generally C-shaped; the straight section 3222 is assembled with the second platform 321 in a guided manner; and the bent section 3223 is at a front end of the straight section 3222. The mounting seat 331 of the first drilling frame assembly 33 can be mounted at a front end of the bent section 3223, and the anchor drill of the first drilling frame assembly 33 can be assembled on a rear side surface of the mounting seat 331. Therefore, the anchor drill is fitted in the avoidance groove formed above the bent section 3223, and when the anchor drill swings or moves upwards in the left-right direction, the avoidance groove can provide sufficient operation space for the anchor drill. In addition, the arrangement of the bent section 3223 can enhance the structural strength of the first platform 322 on the one hand, and reduce the installation height of the anchor drill on the other hand, which is conducive to improving the trafficability of the bolter miner 100.

In some embodiments, the bent section 3223 is provided with a first inclined plane 3221, and the lifting assembly 31 is provided with a second inclined plane 311. The first inclined plane 3221 is configured to fit and cooperate with the second inclined plane 311 to support and limit the work platform 32 when the work platform 32 is retracted to the shortest.

Figure 8:
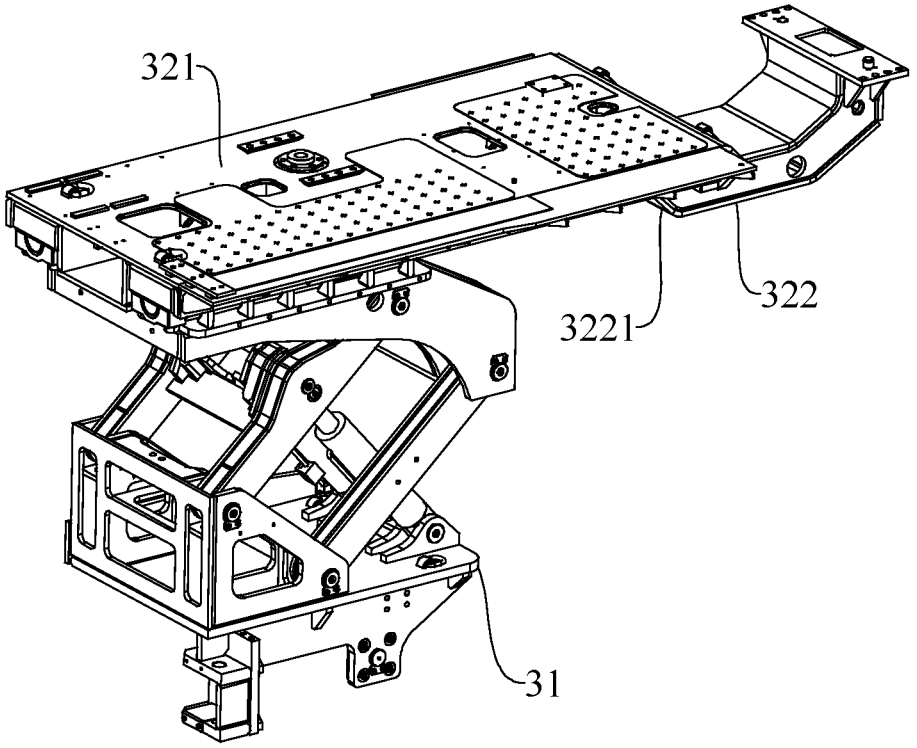
FIG. 8 is a schematic view of a work platform and a lifting assembly in FIG. 5.
Figure 9:
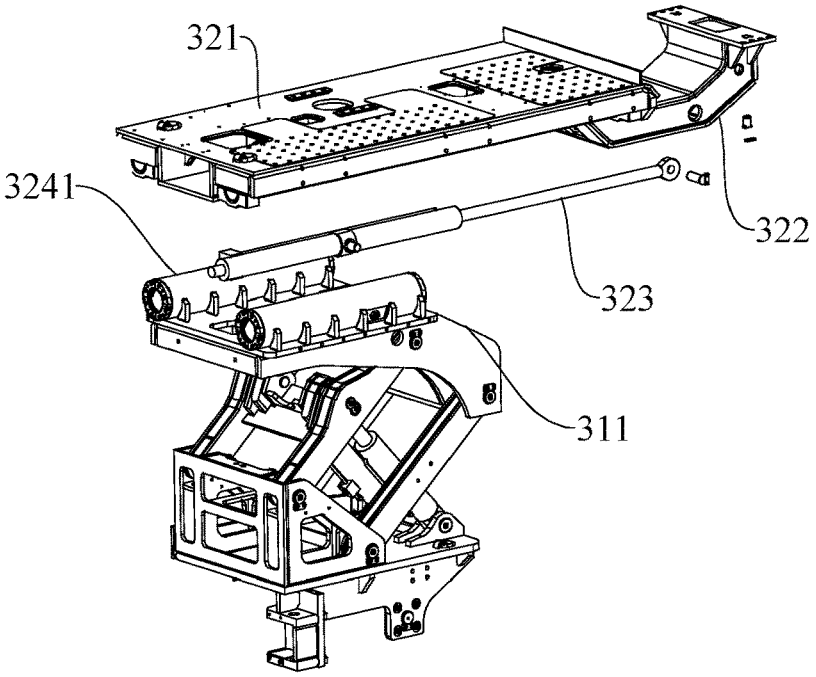
FIG. 9 is an exploded view of the work platform and the lifting assembly in FIG. 8.
Figure 19:
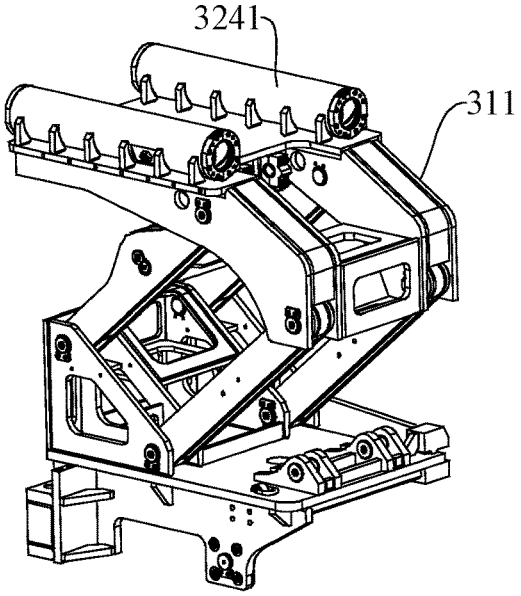
FIG. 19 is a perspective view of the lifting assembly in FIG. 6.

Specifically, as shown in FIG. 8, the first inclined plane 3221 is arranged on a rear side of the bent section 3223. As shown in FIGS. 9 and 19, the second inclined plane 311 is arranged on a front side of the top of the lifting assembly 31. Both the first inclined plane 3221 and the second inclined plane 311 tilt downwards in a direction from the rear to the front, and respective tilt angles of the first inclined plane 3221 and the second inclined plane 311 are generally the same. Therefore, when the first platform 322 retracts, the first inclined plane 3221 can be in close contact with the second inclined plane 311, thereby supporting and limiting the work platform 32, and ensuring the structural compactness and stability.

In some embodiments, the work platform 32 includes a guide member 324. The guide member 324 includes a guide outer cylinder 3241 and a guide inner cylinder 3242. The guide outer cylinder 3241 is connected to the second platform 321 or the lifting assembly 31. The guide inner cylinder 3242 is fitted within the guide outer cylinder 3241 and is slidable along the length direction of the rack 1. The guide inner cylinder 3242 is connected to the first platform 322 and limits a direction of expansion and retraction of the first platform 322. The guide outer cylinder 3241 is provided with an oil injection port, and the oil injection port is configured to inject lubricating oil into the guide outer cylinder 3241 and the guide inner cylinder 3242.

Figure 7:
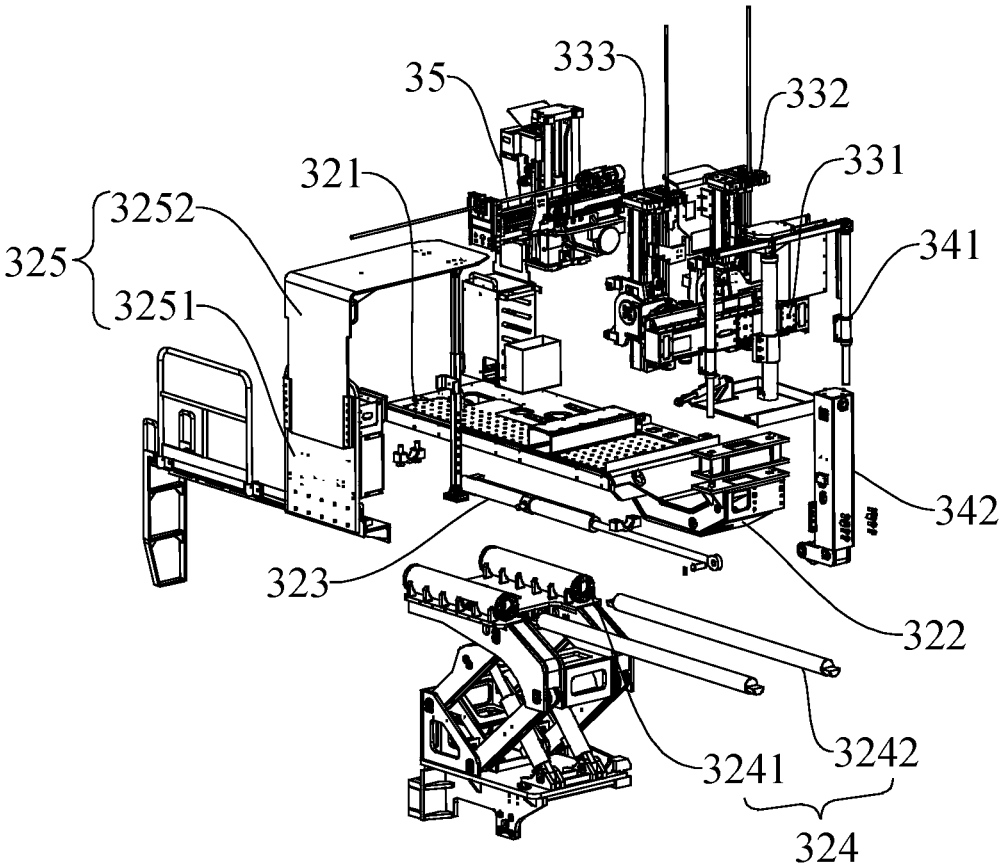
FIG. 7 is an exploded view of the single bolt support device in FIG. 6.

Specifically, as shown in FIG. 7, the guide outer cylinder 3241 can be fixed on the top of the lifting assembly 31, and the guide inner cylinder 3242 is fitted in the guide outer cylinder 3241 in a guided manner and is slidable along the front-rear direction. A front end of the guide inner cylinder 3242 can be hinged with the first platform 322. The arrangement of the guide member 324 enhances the guiding effect and structural strength and enables the work platform 32 to meet impact requirements during bolt support operations.

The guide outer cylinder 3241 can be provided with an oil injection port, through which the lubricating oil can be injected into the guide outer cylinder 3241, to ensure smooth sliding of the guide inner cylinder 3242 and the guide outer cylinder 3241.

Optionally, a seal ring and a mud-scraping ring are provided at a port of the guide outer cylinder 3241, to prevent impurities from entering the guide outer cylinder 3241 and further ensuring the smooth sliding of the guide inner cylinder 3242.

In some embodiments, the bolt support device 3 includes a second drilling frame assembly 35 arranged on the second platform 321. The second drilling frame assembly 35 includes a lifting mechanism 351 and a third anchor drill 352. The lifting mechanism 351 is arranged on the second platform 321. The third anchor drill 352 is arranged on the lifting mechanism 351 and is rotatable in the width direction of the rack 1. The lifting mechanism 351 is configured to lift the third anchor drill 352.

Figure 20:
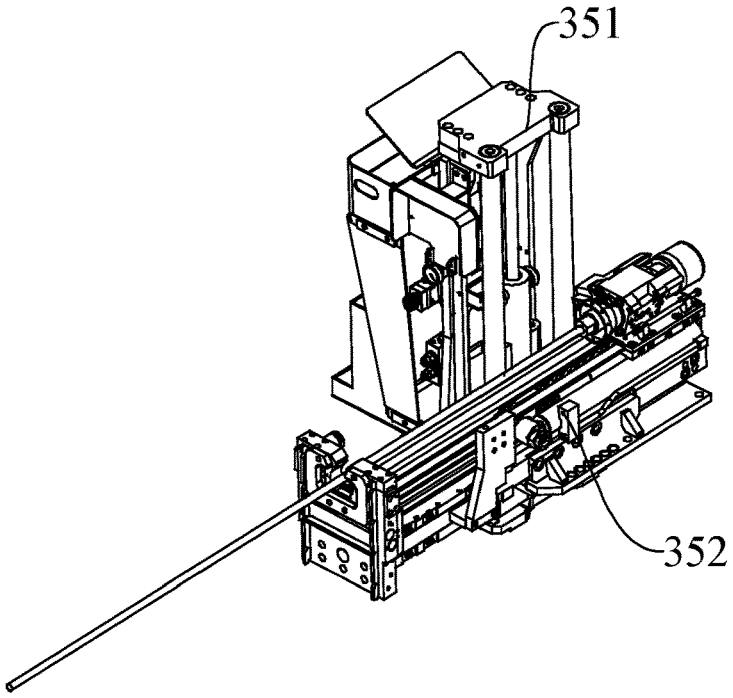
FIG. 20 is a structural schematic view of a second drilling frame assembly in FIG. 1.

Specifically, as shown in FIG. 20, the lifting mechanism 351 can include a lifting frame and a lifting oil cylinder. The lifting frame is provided with a guide rod, and a sliding plate is assembled on the guide rod in a guided manner. One end of the lifting oil cylinder is connected to a top end of the lifting frame, and a bottom end of the lifting oil cylinder is connected to the sliding plate. The third anchor drill 352 can be connected to the sliding plate through swing drive. The third anchor drill 352 is mainly used for bolt support for lateral walls of the tunnel.

During use, the sliding plate can be driven to move upwards by the lifting oil cylinder, thereby moving the third anchor drill 352 in the up-down direction. The swing drive between the sliding plate and the third anchor drill 352 can drive the third anchor drill 352 to swing in the left-right direction, thereby achieving adjustment of the anchor rod installation direction.

It should be noted that during use, the work platform 32 can be adjusted to different expansion and retraction amounts, thereby adjusting a distance between the first drilling frame assembly 33 and the second drilling frame assembly 35, thereby meeting the adaptability to different bolt support row spacing.

In some embodiments, the work platform 32 includes a protective plate 325 arranged on the second platform 321 and between the first drilling frame assembly 33 and the second drilling frame assembly 35. The protective plate 325 includes a first plate 3251 and a second plate 3252. The first plate 3251 is arranged on the second platform 321. The second plate 3252 is arranged on the first plate 3251 and is adjustable in the up-down direction. The second plate 3252 includes a transverse section that extends along the width direction of the rack 1. The transverse section is configured to shelter the operators below.

Specifically, as shown in FIG. 7, the first plate 3251 can be fixedly connected to the second platform 321, and the first plate 3251 can be fixed at a side position of the second platform 321 and extend upwards. The second plate 3252 is an L-shaped plate and can be assembled on the first plate 3251 in a guided manner, meeting operation requirements of operators of different heights and operation requirements of different tunnel heights. The transverse section is a part where the second plate 3252 extends in the left-right direction. As a result, operators can operate inside the protective plate 325, avoiding a risk of being injured by falling coal rock.

The arrangement of the protective plate 325 between the first drill frame assembly 33 and the second drill frame assembly 35 allows the operator to manipulate the first drill frame assembly 33 and the second drill frame assembly 35 simultaneously, so that the first drill frame assembly 33 and the second drill frame assembly 35 can share the protective plate 325.

Figure 11:
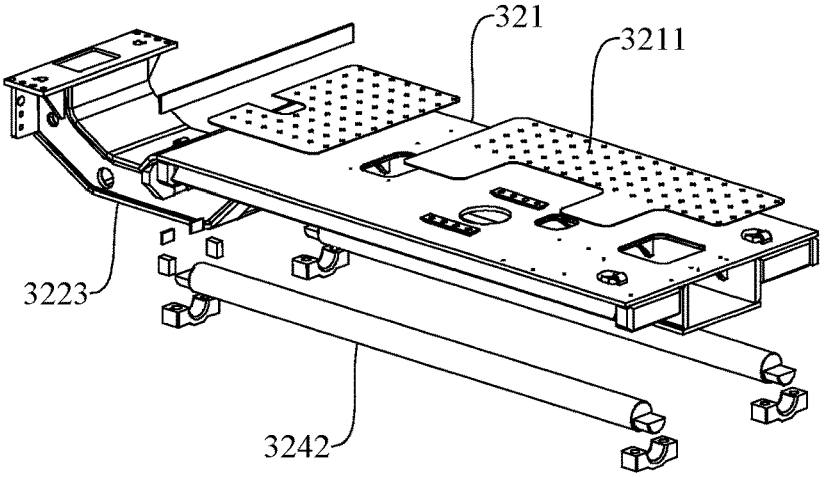
FIG. 11 is an exploded view of the work platform in FIG. 10.

In some embodiments, as shown in FIGS. 10 and 11, the second platform 321 can be provided with an anti-slip plate 3211, thereby preventing operators from slipping.

In some embodiments, the lifting assembly 31 is a scissor type lifting assembly 31, and the work platform 32 is above the lifting assembly 31. The lifting assembly 31 is configured to vertically lift the work platform 32. As shown in FIG. 19, the scissor type lifting assembly 31 has a simple structure and is stable and reliable, which can fully meet the operation requirements in harsh underground conditions.

In some embodiments, when the bolt support device 3 switches to the bolt support position, the operation of the bolter miner 100 can include the following steps:

S1: controlling the cutting device 2 to swing downwards and making the cutting drum 21 of the cutting device 2 come into contact with the ground, so that suspension of the cutting device 2 during a bolt support operation is avoided, the stability of the bolt support operation is ensured;

S2: lifting the lifting assembly 31 until the work platform 32 is higher than the cutting drum 21, so that interference between the work platform 32 and the cutting drum 21 is avoided, and the extension of the work platform 32 is facilitated;

S3: extending the work platform 32 and moving the stabilization assembly 34 on the work platform 32 until the stabilization assembly 34 is above the cutting drum 21;

S4: extending the stabilization assembly 34 and making a top end of the stabilization assembly 34 pressed against and in contact with the tunnel roof, so that a bottom end of the stabilization assembly 34 is pressed against and in contact with the cutting drum 21;

S5: controlling the first drilling frame assembly 33 to complete the bolt support operation.

In some embodiments, when the bolt support device 3 switches to the avoidance position, the operation of the bolter miner can include the following steps:

S1: resetting the first drilling frame assembly 33 and extending the anchor drill of the first drilling frame assembly 33 along a height direction of the rack, so that an occupation size of the first drilling frame assembly 33 in the width direction of the rack is reduced, and the telescopic movement of the work platform 32 is facilitated;

S2: controlling the stabilization assembly 34 to retract and making the stabilization assembly 34 retracted to the shortest size, so that contact between the stabilization assembly 34 and the cutting device 2 is avoided;

S3: retracting the work platform 32 until a free end of the work platform 32 moves behind the cutting drum 21 of the cutting device 2;

S4: lowering the lifting assembly 31 until it reaches the lowest height, so that the bolt support device 3 has a compact structure, avoiding contact with the cutting device 2 during a cutting operation;

S5: controlling the cutting device 2 to swing upwards and completing the cutting operation.

A tunneling system according to embodiments of the present disclosure will be described below.

The tunneling system according to embodiments of the present disclosure includes a bolter miner 100 that can be the bolter miner 100 described in the above embodiments. The tunneling system can also include a transfer machine, a self-moving powered tail, a belt conveyor, and etc. The bolter miner 100, the transfer machine, the self-moving powered tail, and the belt conveyor are arranged in sequence in a direction opposite to a tunneling direction. The coal rock cut by the bolter miner 100 can be transported to the ground through the transfer machine, the self-moving powered tail, the belt conveyor and the like.

The bolter miner 100 of the tunneling system according to embodiments of the present disclosure can not only support the tunnel roof above the cutting device 2, but also achieve parallel and non-parallel operations of tunneling and bolt support, avoiding the existence of large unsupported roof distance at the heading face, and ensuring the structural stability during bolt support operations.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communication or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature. Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Furthermore, the particular features, structures, materials, or characteristics may be combined in any suitable manner in one or more embodiments or examples. Moreover, those skilled in the art can integrate and combine the different embodiments or examples and the features of the different embodiments or examples described in this specification without contradicting each other.

Although embodiments of the present disclosure have been shown and described, it can be appreciated by those skilled in the art that the above embodiments are merely exemplary and are not intended to limit the present disclosure, and various changes, modifications, alternatives and variations may be made in the embodiments within the scope of the present disclosure.

What is claimed is:

1. A bolter miner, comprising:

a rack;

a cutting device arranged on the rack and being swingable up and down, the cutting device being configured to perform a cutting operation; and a bolt support device comprising a lifting assembly, a work platform, a first drilling frame assembly, and a stabilization assembly, wherein:

the lifting assembly is arranged between the rack and the work platform, and the lifting assembly is configured to lift the work platform;

the first drilling frame assembly and the stabilization assembly are arranged on the work platform;

the first drilling frame assembly has a bolt support position where the first drilling frame assembly is above the cutting device and is configured to perform a bolt support operation, and an avoidance position where the first drilling frame assembly is configured to avoid the cutting device to allow the cutting device to perform the cutting operation;

the work platform is telescopic to switch the bolt support position and the avoidance position of the first drilling frame assembly; and the stabilization assembly is configured to be supported between the cutting device and a tunnel roof to enhance stability of the first drilling frame assembly during the bolt support operation.

2. The bolter miner according to claim 1, wherein the bolt support device comprises a first bolt support device and a second bolt support device; the first bolt support device and the second bolt support device are spaced along a width direction of the rack; the first bolt support device is suitable for a bolt support operation on a first side of the tunnel, and the second bolt support device is suitable for a bolt support operation on a second side of the tunnel; the first bolt support device and the second bolt support device are configured to perform staggered bolt support operations in a length direction of the rack.

3. The bolter miner according to claim 1, wherein the first drilling frame assembly comprises a mounting seat and an anchor drill; the mounting seat is arranged on the work platform; the anchor drill is arranged on the mounting seat; a position of the anchor drill relative to the mounting seat in a width direction of the rack is adjustable; and the anchor drill is rotatable relative to the mounting seat.

4. The bolter miner according to claim 3, wherein:

the mounting seat comprises a first seat and a second seat; the first seat and the second seat extend along the width direction of the rack; the first seat is arranged on the rack, and the second seat is arranged on the first seat; a position of the second seat relative to the first seat in the width direction of the rack is adjustable;

the anchor drill comprises a first anchor drill and a second anchor drill; the first anchor drill and the second anchor drill are arranged on the second seat; and a position of at least one of the first anchor drill and the second anchor drill is adjustable relative to the second seat in the width direction of the rack.

5. The bolter miner according to claim 4, wherein in the width direction of the rack, the first anchor drill is on an outer side of the second anchor drill; the second anchor drill is arranged on the second seat and is rotatable in at least one of the length direction and the width direction of the rack; the first anchor drill is arranged on the second seat and a position of the first anchor drill relative to the second seat in the width direction of the rack is adjustable; and the first anchor drill is rotatable in at least one of the length direction and the width direction of the rack.

6. The bolter miner according to claim 4, wherein in the length direction of the rack, the stabilization assembly is on an outer side of the first drilling frame assembly; a first blocking member is connected between the second seat and the stabilization assembly; and the first blocking member is configured to unfold to block coal rock during movement of the second seat.

7. The bolter miner according to claim 1, wherein the stabilization assembly comprises a first support assembly and a second support assembly; the first support assembly and the second support assembly are arranged on the work platform; the first support assembly is extendable upwards and is configured to support the tunnel roof; and the second support assembly is extendable downwards and is configured to support the cutting device.

8. The bolter miner according to claim 7, wherein the first support assembly comprises a first support driver, a crossbar, and a second blocking member; the first support driver is connected to the work platform, and a free end of the first support driver is configured to support the tunnel roof; the crossbar is connected to the free end of the first support driver; the second blocking member is connected between the crossbar and the work platform and is configured to unfold to block coal rock when the first support driver provides support.

9. The bolter miner according to claim 8, wherein the first support assembly comprises a plurality of guide rods that are spaced along an extension direction of the crossbar; the guide rods are connected between the crossbar and the work platform; and the guide rods are configured to limit a driving direction of the first support driver.

10. The bolter miner according to claim 7, wherein the second support assembly comprises a support inner cylinder, a support outer cylinder, and a second support driver; the support outer cylinder is arranged on the work platform; the support inner cylinder is fitted within the support outer cylinder, and the support inner cylinder is slidable relative to the support outer cylinder; the second support driver is arranged within the support outer cylinder, and has a first end connected to the support outer cylinder and a second end connected to the support inner cylinder; the second support driver is configured to drive movement of the support inner cylinder to enable the second support assembly to support the cutting device.

11. The bolter miner according to claim 10, wherein the second support assembly comprises a pressure block rotatably connected to a free end of the support inner cylinder; the pressure block has a fitting surface, and the pressure block is configured to rotate to make the fitting surface and the cutting device fit together when the cutting device is supported by the second support assembly.

12. The bolter miner according to claim 11, wherein the cutting device is provided with a support top, and the support top extends along the length direction of the rack to meet support for the pressure block after the work platform is adjusted to different expansion and retraction amounts.

13. The bolter miner according to claim 11, wherein the support inner cylinder comprises an inner cylinder section and an extension section; the inner cylinder section is fitted within the support outer cylinder in a guided manner, and the extension section is arranged at a free end of the inner cylinder section and at an angle with the inner cylinder section; the extension section extends towards one side of the rack, and the pressure block is rotatably connected to a free end of the extension section.

14. The bolter miner according to claim 7, wherein the first support assembly comprises a plurality of third support drivers and a ceiling panel; the plurality of third support drivers are arranged in parallel and spaced apart from each other; each third support driver has a first end connected to the work platform and a second end rotatably connected to the ceiling panel; the ceiling panel is configured to support the tunnel roof through the extension of the plurality of third support drivers, and the ceiling panel is configured to achieve inclination adjustment by adjusting the plurality of third support drivers to different expansion and retraction amounts.

15. The bolter miner according to claim 14, wherein:

the ceiling panel comprises a main ceiling, an inner ceiling, and an outer ceiling; the plurality of third support drivers are connected to the main ceiling;

the inner ceiling is rotatably connected to the main ceiling and arranged on an inner side of the main ceiling; a first ceiling driver is arranged between the inner ceiling and the main ceiling, and the first ceiling driver is configured to provide inclined support for the inner ceiling to realize up-and-down swing of the inner ceiling;

the outer ceiling is rotatably connected to the main ceiling and is arranged on an outer side of the main ceiling; a second ceiling driver is arranged between the outer ceiling and the main ceiling, and the second ceiling driver is configured to provide inclined support for the outer ceiling to realize up-and-down swing of the outer ceiling.

16. The bolter miner according to claim 14, wherein the first support assembly comprises a limiting outer cylinder and a limiting inner cylinder; the limiting outer cylinder is connected to the work platform; the limiting inner cylinder is fit within the limiting outer cylinder in a guided sliding manner and connected to the ceiling panel; the limiting outer cylinder and the limiting inner cylinder cover an outer side of the third support driver to limit a direction of expansion and retraction of the third support driver when the third support driver extends and retracts.

17. The bolter miner according to claim 7, wherein the stabilization assembly comprises a third support assembly, and the third support assembly comprises a lateral panel and a fourth support driver; the fourth support driver is arranged between the work platform and the lateral panel, and the fourth support driver is configured to drive the lateral panel to move, so that the lateral panel supports a lateral wall of the tunnel.

18. The bolter miner according to claim 17, wherein:

the third support assembly comprises a first connection rod and a second connection rod; the first connection rod has a first end rotatably connected to the work platform and a second end rotatably connected to the lateral panel; the second connection rod has a first end rotatably connected to the work platform and a second end rotatably connected to the lateral panel; the first connection rod and the second connection rod are arranged in parallel and spaced apart from each other along the length direction of the rack;

the fourth support driver has a first end connected to the work platform, and a second end connected to the first connection rod or the second connection rod; and the fourth support driver is configured to drive the first connection rod or the second connection rod to swing to move the lateral panel.

19. The bolter miner according to claim 1, wherein:

the work platform comprises a first platform, a second platform, and a platform driver; the second platform is arranged on the lifting assembly; the first platform is arranged on the second platform, and the first platform is slidable in the length direction of the rack relative to the second platform; the platform driver has a first end connected to the first platform and a second end connected to the second platform; the platform driver is configured to drive the first platform to move to achieve expansion and retraction of the work platform;

the first drilling frame assembly and the stabilization assembly are arranged on the first platform.

20. A tunneling system comprising a bolter miner, wherein the bolter miner comprises:

a rack;

a cutting device arranged on the rack and being swingable up and down, the cutting device being configured to perform a cutting operation; and a bolt support device comprising a lifting assembly, a work platform, a first drilling frame assembly, and a stabilization assembly, wherein:

the lifting assembly is arranged between the rack and the work platform, and the lifting assembly is configured to lift the work platform;

the first drilling frame assembly and the stabilization assembly are arranged on the work platform;

the first drilling frame assembly has a bolt support position where the first drilling frame assembly is above the cutting device and is configured to perform a bolt support operation, and an avoidance position where the first drilling frame assembly is configured to avoid the cutting device to allow the cutting device to perform the cutting operation;

the work platform is telescopic to switch the bolt support position and the avoidance position of the first drilling frame assembly; and the stabilization assembly is configured to be supported between the cutting device and a tunnel roof to enhance stability of the first drilling frame assembly during the bolt support operation.

* * * * *